US007144663B2

(12) United States Patent
Sano et al.

(10) Patent No.: US 7,144,663 B2
(45) Date of Patent: Dec. 5, 2006

(54) METHOD AND APPARATUS FOR LIQUID PREPARATION OF PHOTOGRAPHIC REAGENT

(75) Inventors: Yasushi Sano, Fujinomiya (JP); Yoshitsugu Moizumi, Fujinomiya (JP); Kazuaki Miyashita, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 58 days.

(21) Appl. No.: 10/775,099

(22) Filed: Feb. 11, 2004

(65) Prior Publication Data

US 2004/0157174 A1 Aug. 12, 2004

Related U.S. Application Data

(62) Division of application No. 10/186,392, filed on Jul. 1, 2002, now Pat. No. 6,730,469.

(30) Foreign Application Priority Data

Jul. 5, 2001 (JP) ..... 2001-205288
Jul. 5, 2001 (JP) ..... 2001-205289

(51) Int. Cl.
*G03C 5/00* (2006.01)

(52) U.S. Cl. ..... 430/30; 430/567; 430/569

(58) Field of Classification Search ..... 430/567, 430/569, 30

See application file for complete search history.

(56) References Cited

U.S. PATENT DOCUMENTS 4,863,845 A 9/1989 Murai et al.
5,264,024 A * 11/1993 Bosvot et al. ..... 95/266
5,385,812 A * 1/1995 Bagchi et al. ..... 430/449
6,406,821 B1 6/2002 Ichikawa et al.

* cited by examiner

*Primary Examiner*—Thorl Chea
(74) *Attorney, Agent, or Firm*—Sughrue Mion, PLLC

(57) ABSTRACT

In the apparatus for liquid preparation, the silver halide emulsion contained in a dedicated pot is transferred as liquid by a mohno pump via a piping into a measuring tank. The silver halide emulsion transferred into the measuring tank is measured with a load cell and is melted by heating with a jacket while being stirred by a stirrer. Accordingly, even when a small amount is used as in the case of the silver halide emulsion used in the heat-developable photosensitive material, the time for heating the silver halide emulsion, within the time range from the liquid preparation of the silver halide emulsion to its utilization, can be made short to the utmost, and hence the time elapse in melt can be suppressed. Thus, the time elapse in melt, reagent loss, and mutual contamination in the liquid preparation of photographic reagents can be effectively prevented. Under the preparation condition that the silver halide grains are prepared by adding a solution of a water soluble silver salt at an addition rate equal to or larger than 4 kg/min as converted to the weight of silver, the circulating flux of the circulating current at an opening for circulation is set to be equal to or larger than 500 L/min. By setting the circulating flux of the circulating current to be equal to or larger than 500 L/min., the two solutions added from reacting solution feeding pipes can be instantly diluted by a colloidal solution. Thus, the grain diameter and distribution width thereof can be made small in the preparation of silver halide grains for the purpose of producing a silver halide emulsion.

4 Claims, 6 Drawing Sheets

METHOD AND APPARATUS FOR LIQUID PREPARATION OF PHOTOGRAPHIC REAGENT

This is a divisional of Application No. 10/186,392 filed Jul. 1, 2002 now U.S. Pat. No. 6,730,469; the disclosure of which is incorporated herein by reference.

BACKGROUND OF THE INVENTION

1. Field of the Invention

The present invention relates to a method and an apparatus for liquid preparation of a photographic reagent, and more specifically, to a liquid preparation method for a silver halide emulsion for use in a heat-developable photosensitive material.

2. Description of the Related Art

The photosensitive material is classified broadly into the silver halide photographic sensitive material which uses a gelatin-based binder and the heat-developable photosensitive material which uses a polymer latex-based binder such as an SBR (styrene-butadiene copolymer)-based binder, either photosensitive material using a silver halide emulsion.

A heat-developable photosensitive material which contains an organic silver salt, a reducing agent for silver ion, a polymer latex, and a photosensitive silver halide emulsion, and the like is used as a coating liquid for use in image formation. In this case, the coating liquid is prepared by adding a small amount of the silver halide emulsion to a mother coating liquid containing the organic silver salt, the reducing agent for silver ion, the polymer latex, and the like.

On the other hand, as for the silver halide photographic material, a large amount of the silver halide emulsion is consumed, and accordingly the liquid preparation of the silver halide emulsion has been made with the so-called system line for continuous liquid preparation, as disclosed in Japanese Patent Application Publication No. 47-30315, in which the silver halide emulsion is continuously melted in a heating tank heated by a heating device and a required amount is continuously taken out and measured.

Generally, the liquid preparation operations in the production of the silver halide emulsion include a process for preparing silver halide grains and a process of adding a sensitizing dye. The preparation of silver halide grains is made by a liquid preparation method in which a solution of a water soluble silver salt and a solution of a water soluble halide are mixed together and allowed to react with each other, and there have been used such mixing reactors for reaction by mixing as described in Japanese Patent Application Publication No. 51-83097, U.S. Pat. No. 3,785,777, Japanese Patent Application Publication No. 60-117834, Japanese Patent Application Publication No. 57-92524, and Japanese Patent Application Publication No. 48-21045. The addition of the sensitizing dye is made subsequently to the preparation of silver halide grains.

In the case of the heat-developable photosensitive material, however, the used amount of the silver halide emulsion is extremely smaller as compared with the silver halide photographic material, and hence there is a drawback that the quality deterioration occurs in the prepared liquid remaining in the heating tank with elapse of the time (hereafter referred to as "time elapse in melt") when the conventional liquid preparation method is applied in which the silver halide emulsion is melted continuously in the heating tank heated by the heating device and the amount required for liquid preparation is continuously measured and taken out from the tank. When the used amount is small, there is a problem that the quality deterioration and the reagent loss are enhanced due to the residuals in the conduit pipe in the system line for continuous liquid preparation. Furthermore, the sensitizing dye used in the heat-developable photosensitive material is required to avoid mutual contamination of different kinds of dyes, but it is the case in a conventional liquid preparation apparatus that no equipment is arranged for preventing the mutual contamination. As for the problems of the time elapse in melt, reagent loss and mutual contamination, they are not restricted to the liquid preparation of the silver halide emulsion, but similar troubles occur when the liquid preparation involves a photographic reagent small in its amount used.

On the other hand, as for the silver halide grains in the production of the silver halide emulsion, the diameters of silver halide grains are preferably to be made small, and particularly, in the case of the silver halide emulsion for use in the heat-developable photosensitive material, it is essential to make the grain diameter small and to make the distribution width of the grain diameter narrow for the purpose of suppressing the white turbidity occurring after image formation. In this connection, however, there is a problem that neither satisfactory grain diameters nor a satisfactory distribution width of grain diameter can be obtained by simply using the above-described conventional mixing reactor as it is.

In the process for producing the silver halide emulsion, not only a single kind of emulsion is produced but also different emulsions added with other kinds of sensitizing dyes are produced, and accordingly the contamination of the sensitizing dye occurs if the sensitizing dye used in the last production operation is insufficiently removed at the time of lot renewal, leading to a production failure. In particular, when the sensitizing dye used in the production of the silver halide emulsion for use in the heat-developable photosensitive material contaminates other emulsions, such serious production failures as adverse generation of fog and the like are caused, and hence sufficient removal of the dye is required. Conventionally, the removal of the sensitizing dye remaining in the apparatus in the process is made by warm-water rinsing, acid-solution rinsing, alkali-solution rinsing, and combinations thereof, where there is a problem of persisting silver grains when some portions of the physical objects to be rinsed get away from the rinsing liquids. In addition, there is also a problem that a dedicated equipment is required for disposing the rinsing liquid wastes and the running cost is increased.

SUMMARY OF THE INVENTION

The present invention has been made in view of these above-mentioned circumstances, and an object of the present invention is to provide a method and an apparatus for liquid preparation of photographic reagents which can effectively prevent the problems of the time elapse in melt, and the loss and mutual contamination of reagents, in the liquid preparation of photographic reagents. Another object of the present invention is to provide a method and an apparatus for production of a silver halide emulsion which can reduce the grain diameter and distribution width thereof in the production of silver halide grains for use in the production of a silver halide emulsion, and can also simply deactivate the sensitizing dye remaining in the process of adding a sensitizing dye without generating rinsing water waste.

In order to achieve the above-mentioned objects, the present invention is directed to a method for liquid preparation of photographic reagent comprising at least a process of measuring the photographic reagent and a process of heat-melting the photographic reagent, the method comprising the steps of: transferring, with a pump, the photographic reagent to be measured to a measuring tank via piping without being heated; heating the photographic reagent to be melted after measuring; and repeating the steps for every liquid preparation.

In addition, in order to achieve the objects, the present invention is also directed to an apparatus for liquid preparation of photographic reagent comprising at least a device for measuring the photographic reagent and a unit for heat-melting the photographic reagent, the apparatus comprising: a container for storing the photographic reagent; a measuring tank equipped with a heating device; and a transfer pump rotatable both forward and backward which transfers the photographic reagent in the container to the measuring tank via piping.

According to the present invention, for every liquid preparation a series of the processes are repeated wherein photographic reagents are transferred by a pump via a piping without being heated to a measuring tank, measured, and undergo heat-melt after being measured. Thus, it is possible to make the time of heating the photographic reagent as short as possible, in the whole time course of the liquid preparation of the photographic reagent, and hence the time elapse in melt can be suppressed. Since a series of processes of liquid transfer, measuring, and heat-melt are repeated for every liquid preparation, that is, this is a batch-wise method, it becomes easy to deal with the loss and mutual contamination of reagents. In other words, by letting the pump to rotate backward and blowing the air into the conduit pipe from the transfer-directional end of the piping, the photographic reagent remaining in the piping can be recovered through this backward washing, and hence the loss and mutual contamination of reagents can be suppressed.

The method and apparatus of the present invention are suitable for the method and apparatus for liquid preparation of a silver halide emulsion for use in a heat-developable photosensitive material as a photographic reagent.

In order to achieve the above-mentioned objects, the present invention is also directed to a method for producing a silver halide emulsion in which in a preparation process of preparing silver halide grains by mixing and reacting a solution of a water soluble silver salt with a solution of a water soluble halide for production of a silver halide emulsion, a mixer having an opening for circulation is arranged in a reactor filled with a colloidal aqueous solution, and while the respective two solutions are separately added to the opening for circulation from the respective reacting solution feeding pipes to be diluted in the mixer by the colloidal solution filling thereof, silver halide grains are produced by rapidly mixing by a first stirring device both solutions to be allowed to react with each other, and a circulating flow of the colloidal solution is generated by a second stirring device which flow starts from the mixer to reach the reactor and goes back to the mixer through the opening for circulation; wherein the circulating flux of the circulating flow is made not smaller than 500 L/min. at the opening for circulation under the preparation condition that silver halide grains are prepared by adding the solution of a water soluble silver salt at the rate of not smaller than 4 kg/min. as converted to the weight of silver.

According to the present invention, the solution of a water soluble silver salt and the solution of a water soluble halide are added through the respective reacting-solution feeding pipes, made to flow into the mixer while being diluted at the opening for circulation, mixed and allowed to react with each other in the mixer to produce silver halide grains. In this connection, although it is possible to reduce the silver halide grain diameter and distribution width thereof by reducing the concentrations of the reacting solutions, that is, the solutions of a water soluble silver salt and a water soluble halide, a realistic unit in accord with this manner is impossible in view of the productivity. Thus, it is required that the silver halide grain diameter and distribution width thereof can be made small even with the addition of the solution of a water soluble halide in such an amount, as converted to the weight of silver, that the unit works as a realistic one. Accordingly, in the present invention, under the condition that the preparation of silver halide grains is made by adding the solution of a water soluble silver salt at a rate of 4 kg/min. as converted to the weight of silver, the circulating flow rate of the circulating flow at the opening for circulation is set not to be smaller than 500 L/min. By setting the circulating flow rate of the circulating flow not to be smaller than 500 L/min, both solutions added from the reacting solution feeding pipes can be instantly diluted by the colloidal solution, and hence it is possible to prepare silver halide grains having small diameters with a narrow distribution width thereof, even under the preparation condition that the silver halide grains are prepared by adding the solution of a water soluble silver salt at a rate not smaller than 4 kg/min. as converted to the weight of silver.

As a preferable aspect of the present invention, in addition to the above-mentioned circulating flow rate, it is preferable to complete the reaction in a short time by setting the addition flow rate of both solutions not to be smaller than 20 L/min.

In addition, as another preferable aspect of the present invention, it is recommended to further add the solution of a water soluble silver salt and the solution of a water soluble halide subsequently to preparation of silver halide grains, on the basis of the potential of silver.

In order to achieve one of the above-mentioned objects in the present invention, in the process involving adding sensitizing dyes for production of a silver halide emulsion, after completion of the process the interior of the apparatus in the process is subjected to light exposure wherein the sensitizing dye is deactivated.

In order to achieve the object in the present invention, in the device for adding a sensitizing dye to prepare silver halide grains, a device for light exposure is arranged with which the interior of the apparatus undergoes light exposure.

According to the present invention, the interior of the apparatus is subjected to light exposure after completion of a process to deactivate the sensitizing dye, and hence it is possible to clean infallibly all over the interior mirror surface of the tank. In this manner, no rinsing water waste is generated, and the cost can be reduced.

The method and apparatus for producing silver halide emulsion of the present invention is suitable for the method and apparatus for producing a silver halide emulsion for use in a heat-developable photosensitive material which requires, for the purpose of suppressing the white turbidity occurring after image formation, the smaller diameter of silver halide grains and narrower distribution width thereof than the silver halide grains for use in the silver halide photographic material, and uses a sensitizing dye that causes a serious production failure when it contaminates other emulsions.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

By referring to the attached figures, detailed description will be made on the preferred embodiments of the method and apparatus for liquid preparation of photographic reagents related to the present invention.

Figure 1:
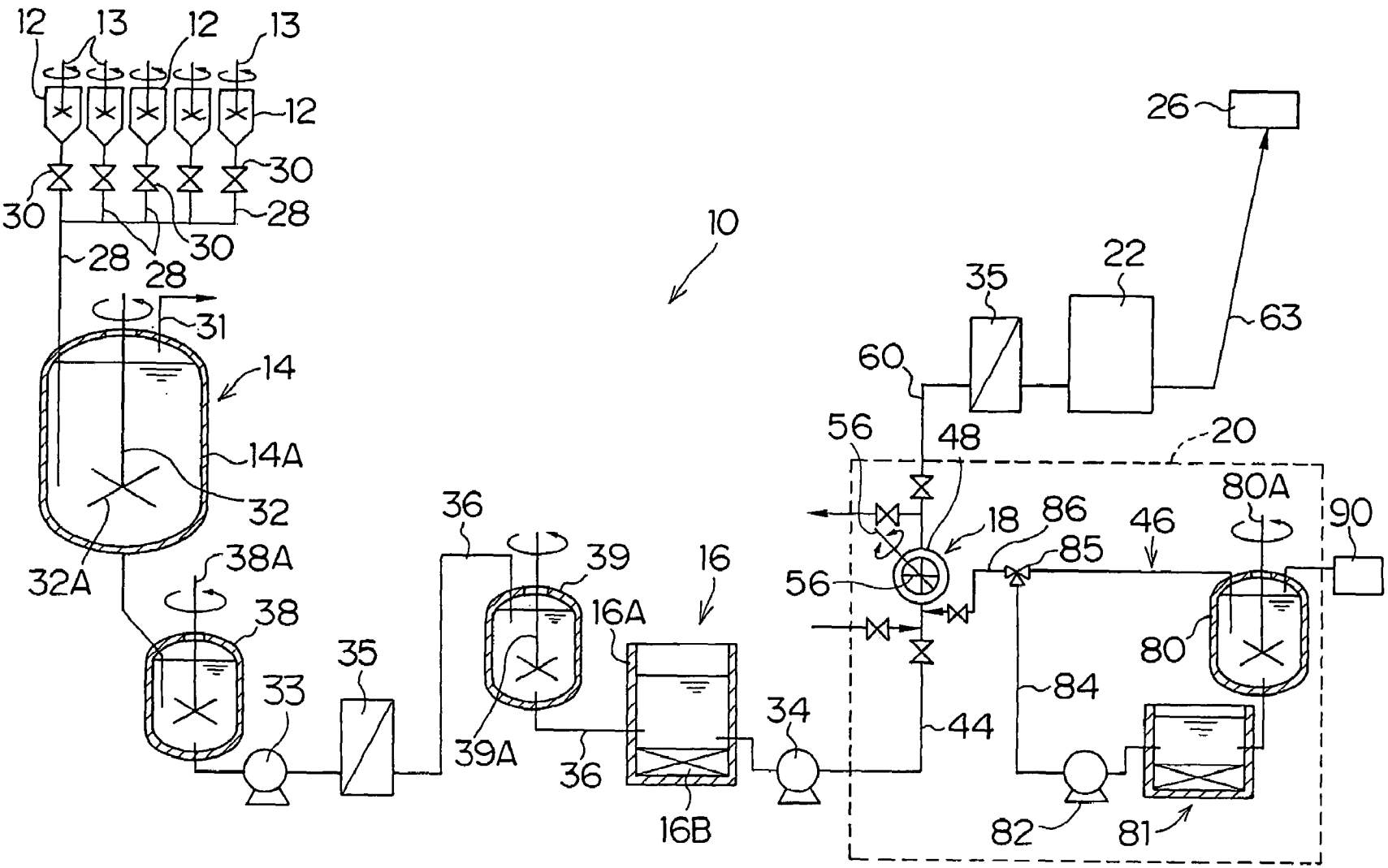
FIG. 1 is an overall block diagram of the whole system for producing the heat-developable photosensitive material incorporating the apparatus for liquid preparation of the photographic material according to an embodiment of the present invention.

FIG. 1 shows an example of the system incorporating the apparatus for liquid preparation of photographic reagents of the present invention, and illustrates an overall block diagram of the whole system for producing a heat-developable photosensitive material. Incidentally, as for the liquid preparation of photographic reagents, illustration will be made below on an example of silver halide emulsion.

As shown in the same figure, the production apparatus 10 comprises a plurality of component-liquid tanks 12 each having a stirrer 13. The respective component-liquid tanks 12 store such liquids composing a coating liquid as an organic silver salt solution, a reducing agent solution for silver ion, an SBR based binder liquid, and the like, and these liquids composing a coating liquid are transferred by their own weights to a preparation-deaeration tank 14 by opening the valves 30 fixed to the respective liquid transfer pipes 28.

The preparation-deaeration tank 14 has a sealed-tank-shaped stirring vessel 14A, and a pressure-reduction pipe 31 is fixed at the upper head space which pipe is extended to be connected to a pressure-reduction unit (not shown). In the stirring vessel 14A, the respective liquids composing a coating liquid are mixed under a reduced pressure by a stirrer 32 to prepare the mother coating liquid. The mother coating liquid prepared and deaerated in the preparation-deaeration tank 14 is transferred to and reserved temporarily in a stock tank 38 equipped with a stirrer 38A, and is subsequently transferred to a stock tank 39 equipped with a stirrer 39A by a liquid transfer pump 33 arranged in a piping 36 via a filter 35. Then the mother coating liquid is transferred by its own weight via the piping 36 from the stock tank 39 to a supersonic floatation deaerator 16.

The supersonic floatation deaerator 16 is a tank-shaped deaerator having a supersonic generator 16B arranged at the bottom portion of a floatation vessel 16A, in which the mother coating liquid is deaerated by supersonic irradiation to grow and cluster the air bubbles in the mother coating liquid and to float the bubbles to the liquid surface for deaeration. The mother coating liquid deaerated by the supersonic floatation deaerator 16 is transferred to a mixing system 20 by a liquid transfer pump 34 arranged in a piping 44.

The mixer system 20 mainly constituted with an in-line mixer 18 and an addition unit 46, and the silver halide emulsion is added by the addition unit 46 to the mother coating liquid flowing into the mixer 18.

The addition unit 46 comprises an addition liquid storage tank 80 equipped with a stirrer 80A, a supersonic floatation deaerator 81, and a circulating line 84 equipped with a circulating pump 82. The silver halide emulsion prepared by the liquid preparing method to be described below is stored in the addition liquid storage tank 80. The silver halide emulsion is deaerated by a supersonic floatation deaerator 81, and circulated by the circulating pump 82 along the circulating line 84. From the circulating line 84, an addition piping 86 is branched via a three-way valve 85, and the addition piping 86 is connected to the inflow piping 44. Thus, by controlling the three-way valve 85, the silver halide emulsion can be transferred to the addition piping 86, and can be added to the mother coating liquid in the inflow piping 44.

The in-line mixer 18 is constituted with a mixer vessel 48 having a spherically formed interior surface, stirring blades 56 supported by a revolving shaft 54, and a back-and-forth driving device (not shown) for the revolving shaft 54. The mother coating liquid and the silver halide emulsion flow into the interior of the mixer 48 and are mixed together by revolving the stirring blades 56. Thus, the coating liquid for use in the heat-developable photosensitive material is prepared.

The prepared coating liquid is transferred to a pipe line-type continuous deaerator 22 through an outflow pipe 60 via the filter 35, where the final deaeration is carried out. As the pipe line-type continuous deaerator 22, a device described in Japanese Patent Application Publication 53-139274 can be used, in which the micro to small bubbles are dissolved into the liquid and deaeratied by supersonic irradiation under a pressurized condition of the coating liquid flowing in the pipe line arranged in the liquid for supersonic wave propagation. The coating liquid deaerated with the pipe line-type continuous deaerator 22 is transferred by a piping 63 to an application head 26 and is applied on a substrate (not shown).

Figure 2:
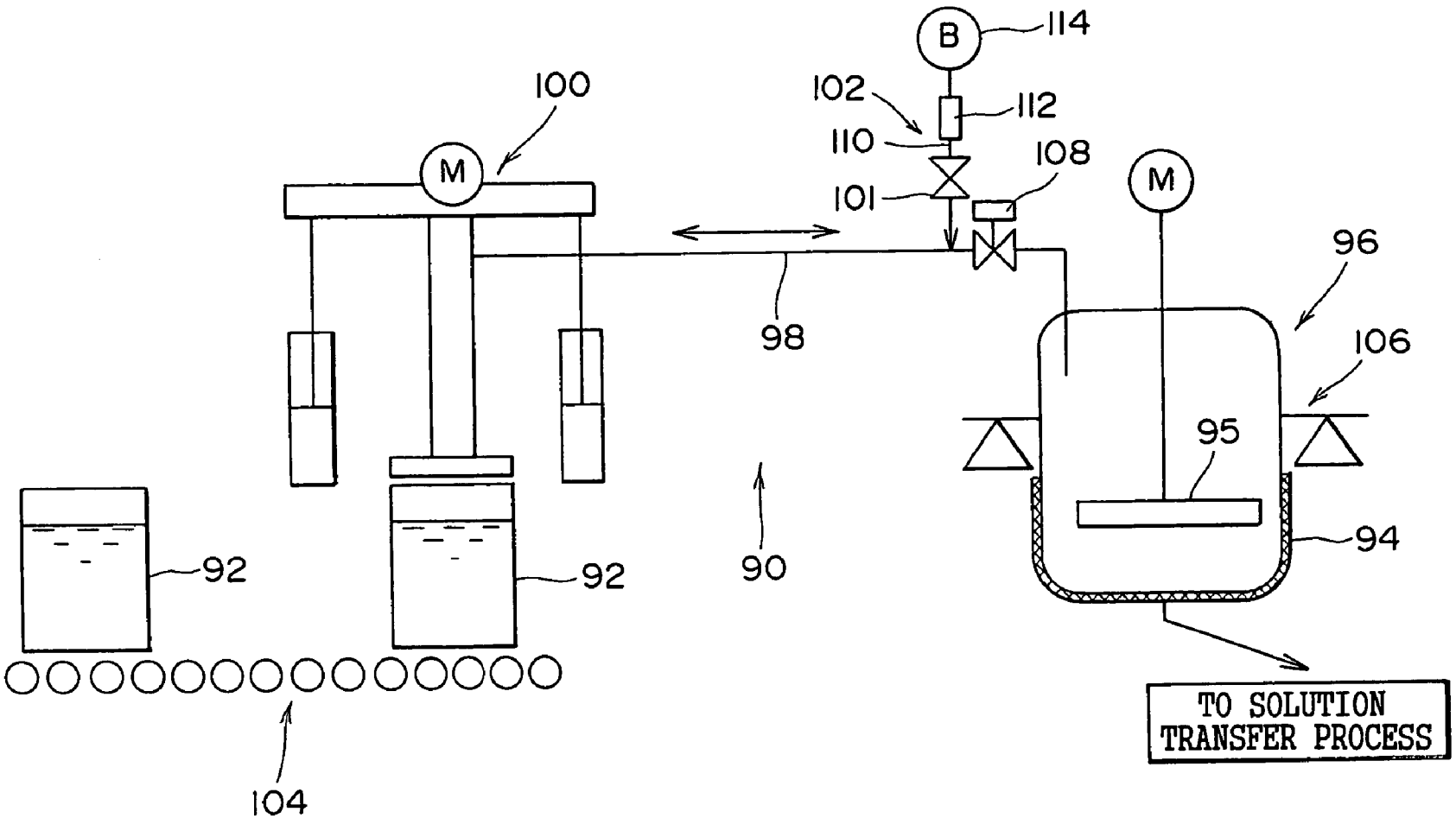
FIG. 2 is a schematic view of a liquid preparation unit in the system.

Then, description is made on the constitution of the liquid preparation unit 90 of the present embodiment which prepares the silver halide emulsion and transfers the emulsion to the addition liquid storage tank 80. FIG. 2 is an overall schematic view of the liquid preparation unit 90 of the present embodiment.

The liquid preparation unit 90 mainly comprises a dedicated pot 92 exclusively used for storing the silver halide emulsion, a measuring tank 96, a transfer pump 100 rotatable both forward and backward which transfers via a pipe 98 the silver halide emulsion in the dedicated pot 92 to the measuring tank 96, and a device 102 for backward washing of the piping.

The dedicated pot 92 is formed so as to circumvent the mutual contamination of the sensitizing dyes used in the heat-developable photosensitive material, and is moved from its depository to the location of a transfer pump 100 by a belt conveyer 104.

The measuring tank 96 is equipped with a load cell 106, with which the silver halide emulsion transferred from the dedicated pot 92 is measured by means of a weight-type measuring method. The lower portion of the measuring tank 96 is wound with a jacket 94 capable of circulating warm water, and a stirrer 95 is arranged in the inside of the tank. Thus, the measured silver halide emulsion is melted by heating while being stirred.

A transfer pump rotatable both forward and backward and capable of transferring high-viscosity liquid can be used as the transfer pump 100, but a mohno pump rotatable both forward and backward is suitable as the transfer pump 100 and hereafter description will be made assuming that a mohno pump is used as the transfer pump 100. As the mohno pump 100, for example, a "Discharger" manufactured by Heishin-Seibi Co. Japan can be used. The mohno pump 100 is preferably of the two-stage control so as to be capable of switching from high to low flow rate. By switching from a high to a low flow rate a little earlier than the completion of transferring the silver halide emulsion, the precision of the transfer rate can be enhanced. The operation pressure of the mohno pump 100 is preferably in the range of 1 to 6 $kg/cm^2$, and more preferably in the range of 2 to 4 $kg/cm^2$. For sealing the mohno pump 100, there are available a tube seal method and a rubber-plate seal method, the former being suitable. As the material for the seal stator, Viton is suitable in view of the photographic performance. For in the transfer of the silver halide emulsion, the operation pressure lower than 1 $kg/cm^2$ makes the transfer rate too slow and consequently the time needed for liquid preparation becomes long, which adversely affects the quality of the silver halide emulsion. The operation pressure larger than 6 $kg/cm^2$ tends to cause leak from the seal portion, and consequently a high-precision liquid preparation becomes impossible. When ethylene propylene rubber is used as the material for the stator of seal, there is a problem that "fog" occurs concerning the photographic performance, but the use of Viton does not cause such a problem.

A valve 108 is arranged at the one end of the piping 98, which valve is opened and closed according to the driving of the mohno pump 100. In other words, the valve 108 is opened when the mohno pump 100 is driven, while the valve 108 is closed at the instant when the mohno pump 100 is stopped. Thus, the transfer of the addition liquid is halted at about the same time when the mohno pump 100 is stopped, and accordingly the time lag between the stop of the mohno pump 100 and the practical halting of the liquid transfer can be made small.

The device 102 for backward washing of the piping is made up in such a way that an end of a high-pressure air pipe 110 having an air valve 101 is connected to an end of the piping 98, while the other end of the pipe 110 is connected to a blower 114 via a filter 112. After completing the liquid preparation of the silver halide emulsion, the mohno pump 100 is driven to rotate backward, and concurrently high-pressure air is blown into the piping 98 from the blower 114 to bring back for recovery the silver halide emulsion persisting in the piping 98 into the dedicated pot 92. Thus, the loss of the silver halide emulsion remaining in the piping 98 can be made as small as possible, and simultaneously the mutual contamination can also be prevented to the utmost. Particularly, for the quality and performance of the heat-developable photosensitive material, it is crucial to circumvent the mutual contamination of the sensitizing dyes used in the heat-developable photosensitive materials.

In the liquid preparation unit 90 constituted as described above, the silver halide emulsion contained in the dedicated pot 92 is transferred by the mohno pump 100 to the measuring tank 96 via the piping 98. In this case, preferably, the end of the piping 98 is inserted into the inside of the measuring tank 96 and particularly arranged close to and in parallel with its inside wall. Thus, the silver halide emulsion being transferred via the piping 98 comes down as drops near the inside wall of the measuring tank 96, generation of bubbles being suppressed. The silver halide emulsion transferred into the measuring tank 96 is measured with the load cell 106 and melted by heating with the jacket 94 while being stirred by the stirrer 95. Accordingly, even with such a small amount of silver halide emulsion as used in the heat-developable photosensitive material, the heating time of the silver halide emulsion can be made as short as possible in the course of time from the completion of preparation of the silver halide emulsion to its use, and hence the time elapse in melt can be suppressed. Since a batch-wise method for liquid preparation is adopted in which a series of processes of liquid transfer, measuring, and heat-melt are repeated for every liquid preparation, on completion of the liquid preparation, the mohno pump 100 is driven to rotate in reverse to the liquid transfer, the valve 108 is closed, the air valve 101 is opened, and the air is blown into the piping 98 from the blower 114, so that the liquid remaining in the piping 98 can be recovered into the dedicated pot 92. In this way, the reagent loss and mutual contamination can be suppressed to the utmost. The prepared silver halide emulsion is transferred to the addition liquid storage tank 80 through the liquid transfer processes.

In the present embodiment, description is made on the silver halide emulsion as a photographic reagent, however, the method and apparatus for liquid preparation of the present invention is not limited to this, but can be applied to any photographic reagent which requires the prevention of the time elapse in melt, and the loss and mutual contamination of reagents in liquid preparation. In addition, in the present embodiment, description is made on the case where the measuring tank and the addition liquid storage tank 80 are provided separately, but the addition liquid storage tank 80 can also be used as a dual-purpose measuring tank by equipping it with the load cell 106 and the jacket 94.

With reference to the attached drawings, description will be made below on the preferred embodiments of the method and apparatus for preparation of the silver halide emulsion of the present invention.

Figure 3:
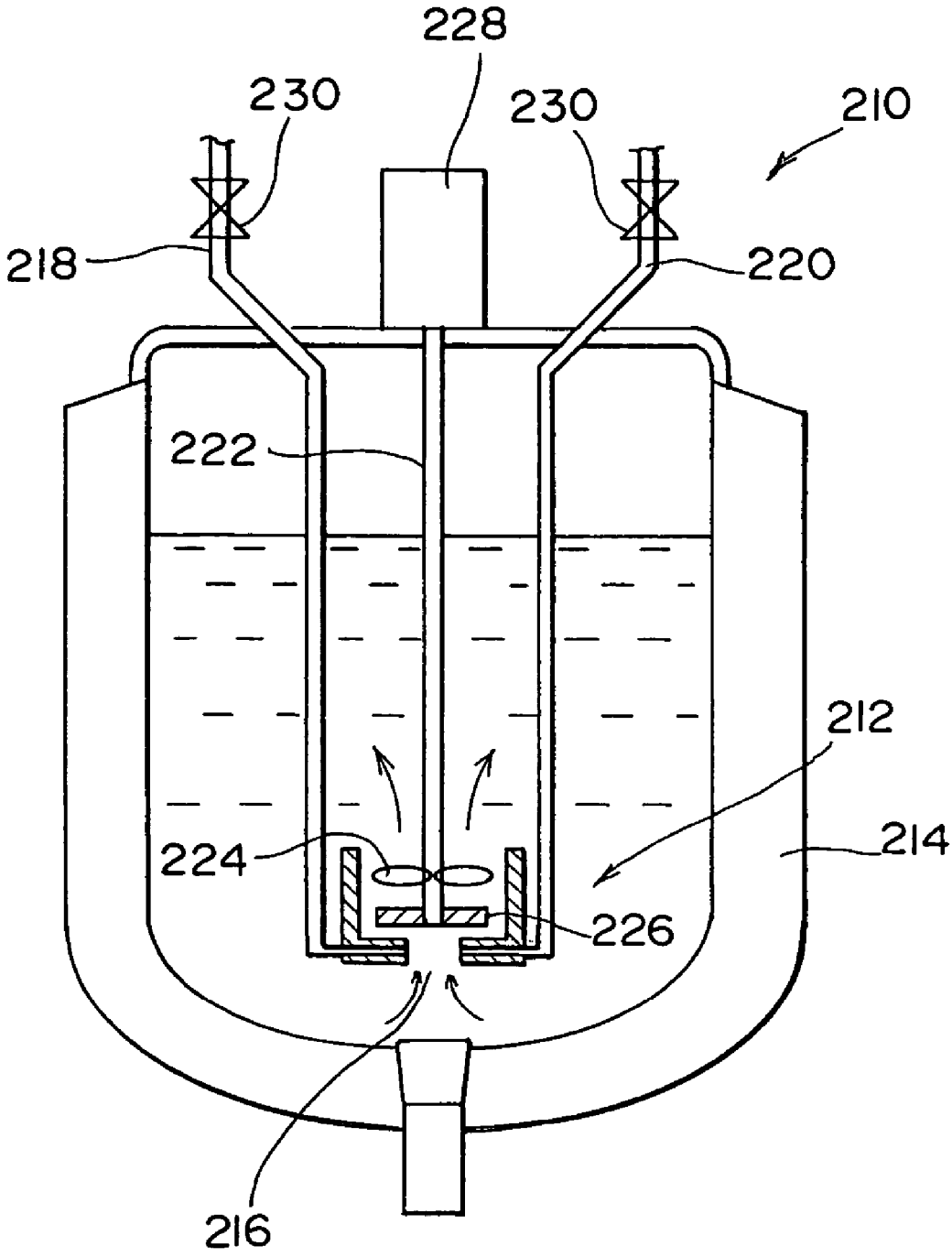
FIG. 3 is a schematic view of a unit for producing silver halide grains in the method for producing silver halide emulsion according to the embodiment of the present invention.
Figure 4:
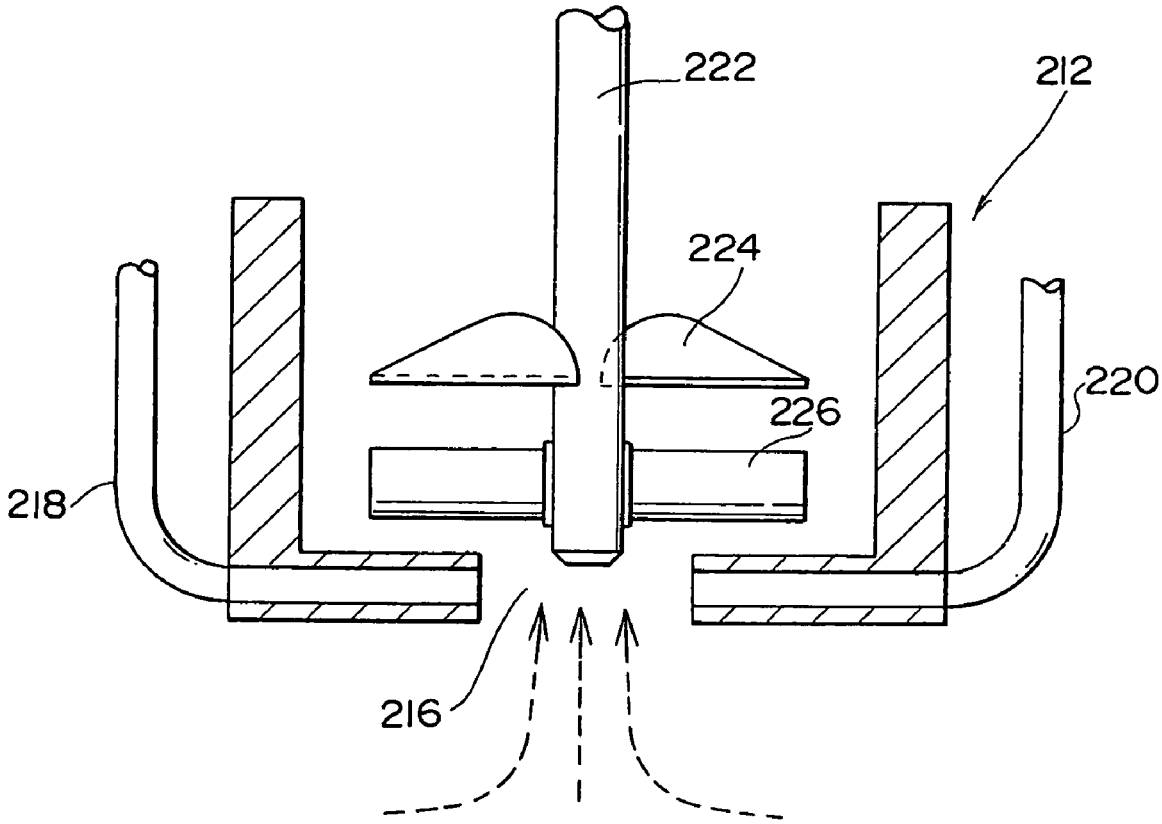
FIG. 4 is an enlarged sectional view of a mixer part in the production unit.

FIG. 3 is a schematic view of a unit 210 for preparing silver halide grains arranged for the process of preparing silver halide grains in the method for producing a silver halide emulsion of the present invention, and FIG. 4 is a sectional view of a mixer 212.

As these figures show, the unit 210 is constituted in such a way that a mixer 212 having an open upper end and a circular opening 216 for circulation at the bottom end is arranged in the interior of a reactor 214 filled with a colloidal aqueous solution, and the interior of the mixer 212 is also filled with a colloidal aqueous solution. A pair of reacting solution feeding pipes 218 and 220 for addition of both solutions of a water soluble silver salt and of a water soluble halide are extended and arranged in such a way that the pipes come from the outside of the reactor 214, pass through the interior of the reactor 214, pass through the routes bored in the bottom plate of the mixer 212, and reach the rim of the opening 216 for circulation. The openings for addition of the reacting solution feeding pipes 218 and 220 for both solutions are arranged at the opening 216 for circulation so as to face to each other. The production capacity of the unit 210 for preparing silver halide grains is so designed that it can prepare silver halide grains with the addition rate of the solution of a water soluble silver salt of not smaller than 4 kg/min. as converted to the weight of silver. In this connection, although it is possible to suppress the silver halide grain diameter by lowering the addition rate as converted to the weight of silver, that is, by lowering the silver concentration in the solution of a water soluble silver salt, even when the degree of dilution by the colloidal solution is poor for the solutions added from the reacting solution feeding pipes 218 and 220, but a realistic unit in accord with this manner is impossible in view of the productivity. Accordingly, it is required that the silver halide grain diameter and distribution width thereof can be made small even when the production of silver halide grains is carried out with the addition rate of the solution of a water soluble silver salt of not smaller than 4 kg/min. as converted to the weight of silver.

Inside the mixer 212 and near the opening 216 for circulation, there are arranged two stages of upper and lower stirring blades 224 and 226 which are supported by a revolving shaft 222, which is rotated by the motor 228. The lower stirring blades 226 of the two stages of stirring blades 224 and 226 are so fabricated that they can rapidly mix the solution of a water soluble silver salt and the solution of a water soluble halide and allow the two solutions to react with each other. On the other hand, the upper blades 224 are so fabricated that they can generate circulating current starting from the opened upper end of the mixer 212, reaching the interior of the reactor 214, and coming back to the mixer 212 through the opening 216 for circulation. The circulating flux of the circulating current generated by the upper blades 224 is designed so as to be equal to or larger than 500 L/min. at the location of the opening for circulation 216. A larger circulating flux can be achieved by enlarging the upper blades 224 and the opening diameter of the opening for circulation 216, and the like.

The addition fluxes of the two solutions through the reacting solution feeding pipes 218 and 220 are designed so as to be equal to or larger than 20 L/min. and controllable precisely. Larger addition fluxes can be achieved by enlarging the pipe diameters of the reacting solution feeding pipes 218 and 220, and generating suction forces in the neighborhood of the openings for addition of the reacting solution feeding pipes 218 and 220 by generating a larger flow rate of the above mentioned circulating current in the neighborhood of the opening for circulation where the two solutions are added. The enhanced precision in controlling the addition flux in each of the reacting solution feeding pipes 218 and 220 can be achieved by arranging a flux adjustment valve 230 as shown in FIG. 5 in each of the pipes.

Figure 5:
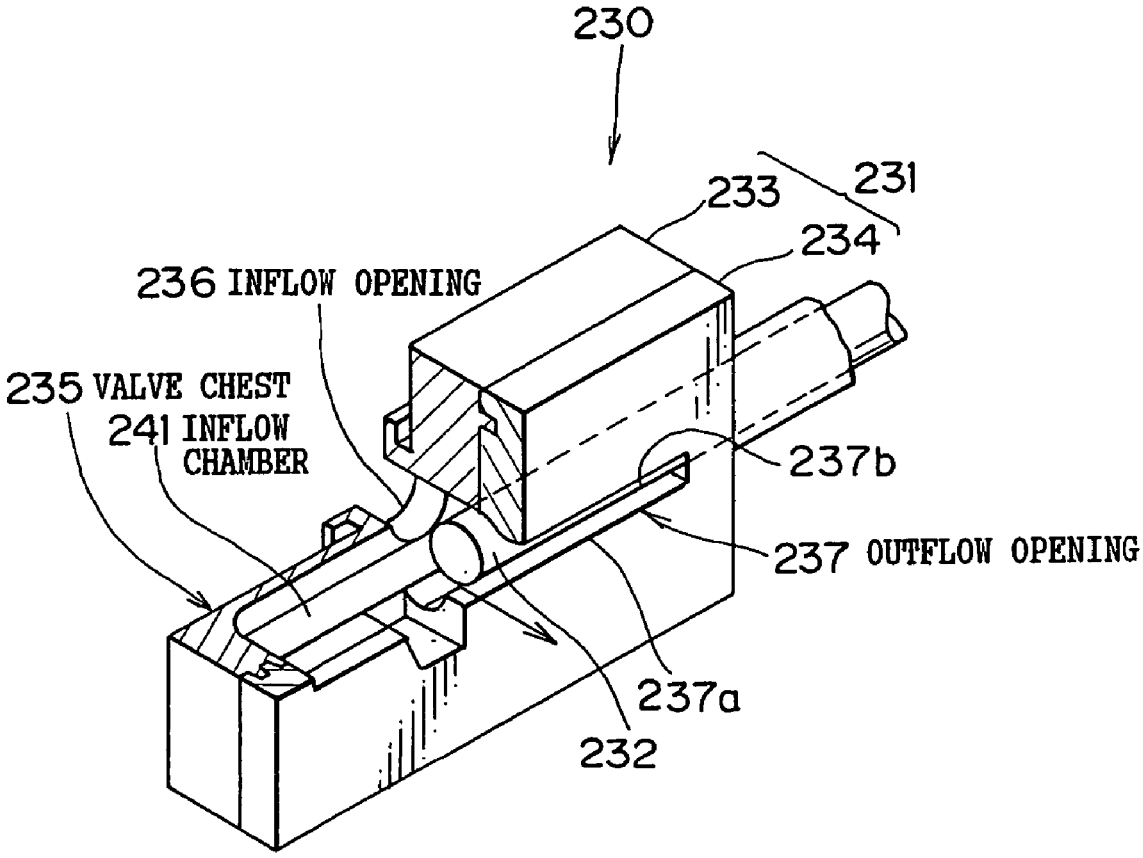
FIG. 5 is an illustrative view of a flow adjustment valve used in the flow control of a reacting solution feeding pipe.

As FIG. 5 shows, the valve body 231 of the flux adjustment valve 230 comprises a valve casing 233 and a valve plate 234, and a valve chest 235 having an inflow chamber 241 is arranged inside the valve body, the solution of a water soluble silver salt or the solution of a water soluble halide flowing into the inflow opening 236. In the valve chest 235, there is arranged an outflow opening 237 having long openings 237*a* and 237*b* along the direction perpendicular to the outflow direction of the fluid. At the outflow opening 237, there is arranged a valve rod 232 which is driven to make sliding movement by a motor (not shown) as a driving source. The opening area of the outflow opening 237 exposed to the valve chest 235 is varied proportionally according to the sliding movement magnitude of the valve rod 232, and the solution of a water soluble silver salt or the solution of a water soluble halide flowing into the inflow chamber 241 in the valve chest 235 is made to flow out from the outflow opening in a flux proportional to the opening area. As for the flux adjustment valve 230, there is an excellent linear relationship between the opening degree of the valve and the flux, so that a high precision flux adjustment can be performed over a wide range of flux.

In the preparation of silver halide grains by using the unit 210 for preparing the silver halide grains constructed as described above, under the preparation condition that the preparation of silver halide grains is made with the addition rate of the solution of the water soluble silver salt equal to or larger than 4 kg/min. as converted to the weight of silver, the flow rate of the circulating current at the opening 216 for circulation is set to be equal to or larger than 500 L/min., and preferably to be equal to or larger than 1000 L/min, and further more preferably to be equal to or larger than 2000 L/min. Thus, both solutions added from the reacting solution feeding pipes 218 and 220 can be instantly diluted with the colloidal solution, and hence silver halide grains of small diameters can be prepared with a narrow distribution width of the grain diameters, even under the preparation condition that the preparation of silver halide grains is made with the addition rate of the solution of the water soluble silver salt equal to or larger than 4 kg/min. as converted to the weight of silver.

Since the long time of mixing and reaction of both solutions yields enhanced growth of the grains resulting in the increase of grain diameter, it is preferable to complete the reaction in a short time by setting the addition fluxes of both solutions to be equal to or larger than 20 L/min., preferably to be equal to or larger than 30 L/min., and more preferably to be equal to or larger than 40 L/min. Thus, silver halide grains of small diameters can be produced in a higher precision with a narrow distribution width of the grain diameters.

Furthermore, after the completion of the preparation of silver halide grains, by adding the solution of the water soluble silver salt and the solution of the water soluble halide on the basis of the potential of silver, the distribution width of the grain diameter can be made further narrower owing to the grain diameters tending to be uniform.

Thus, the present invention is suitable, of course, for the method and apparatus for producing the silver halide emulsion for use in the silver halide photographic material, and particularly suitable for the method and apparatus for producing the silver halide emulsion for use in the heat-developable photosensitive material which requires much smaller grain diameters and a much narrower distribution width thereof for suppression of the white turbidity occurring after image formation.

Figure 6:
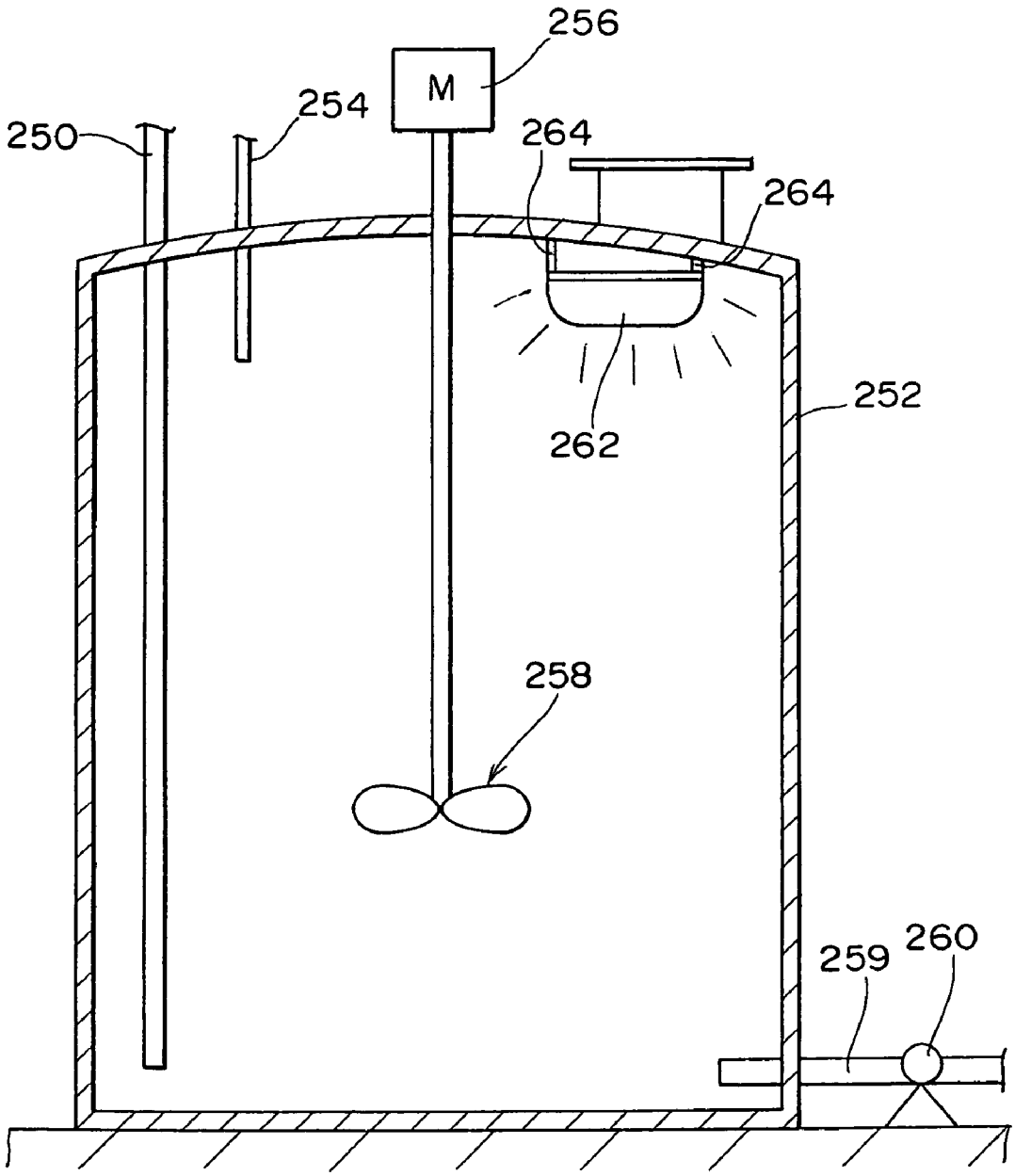
FIG. 6 is an illustrative view of an addition tank equipped with a device for light exposure.

FIG. 6 is a schematic view of an addition tank arranged for the process of adding dyes in the method for producing the silver halide emulsion of the present invention.

As FIG. 6 shows, as for the silver halide grain solution prepared in the process for preparing the silver halide grains, the silver halide grains are washed in the process for washing (not shown), and then the silver halide grain solution is fed into the interior of the addition tank 252 through a feeding pipe 250. On the other hand, a sensitizing dye is added from a piping for addition 254. The silver halide grain solution and the sensitizing dye are stirred and mixed by a stirrer 258 revolved by a motor 256. The stirred and mixed solution is discharged from a discharge pipe 259 arranged at the lower portion of the addition tank 252 by a discharge pump 260.

In the process of adding the dye, it is required to prevent contamination by the sensitizing dyes used up to that time in emulsion production, when the kind of the silver halide emulsion is changed over. Herefrom, conventionally, the addition tank 252 is cleaned after it is made empty by combining warm-water rinsing, acid-solution rinsing, alkali solution rinsing, so that the dye does not remain in the addition tank 252. In this way, however, there are a problem of silver grains persisting in the tank when some portions in the tank get away from the rinsing and a problem of the rinsing solution wastes.

In this connection, in the process of producing the silver halide emulsion of the present embodiment, a device for light exposure 262 is arranged in the addition tank 252, with which the interior surface of the addition tank 252 undergoes light exposure so that the sensitizing dye is deactivated.

The light exposure device 262 is arranged in the head space portion of the interior of the addition tank 252, and hanged from the ceiling of the tank with hanging arms 264. As the light emitted from the light exposure device 262, ultraviolet light is efficient, but the light exposure device 262 preferably comprises an incandescent lamp in view of the workability and safety. The exposure time when a 100-W incandescent lamp is used is equal to or longer than 30 min., and preferably equal to or longer than 60 min. and more preferably equal to or longer than 120 min.

The light emitted from the light exposure device 262 set up as described above is repeatedly reflected on the interior surface, which is a mirror, of the addition tank 252 so that the light can reliably reach all over the interior surface of the addition tank 252. Accordingly, the sensitizing dye is deactivated all over the interior surface of the addition tank 252, and hence the persistence of silver grains can be reliably prevented.

In addition, according to the present invention, the sensitizing dye remaining in the addition tank 252 is deactivated by light exposure, and contrary to the conventional processing, no rising solution wastes are generated and accordingly no silver grains are discharged as a loss from the addition tank. In the present invention, the time for cleaning the interior surface of the addition tank 252 can be reduced as compared to the conventional cleaning work which uses simultaneously the warm-water rinsing, acid-solution rinsing, and alkali-solution rinsing, and hence the time required for renewal of the lot for producing silver halide emulsion can also be reduced. Then, the productivity is improved.

Thus, the present invention is suitable, of course, for the method and apparatus for producing a silver halide emulsion for use in a silver halide photographic material, and particularly suitable for the method and apparatus for producing a silver halide emulsion for use in a heat-developable photosensitive material which uses a sensitizing dye causing such production failures as adverse generation of fog and the like when it contaminates other emulsions.

EXAMPLES (1) Description will be made below in terms of specific numerical values on the method and apparatus for liquid preparation of photographic reagents of the present invention.

Examples 1 to 3 listed in Table 1 represent the batch-wise methods for liquid preparation of the present method, wherein the silver halide emulsion for use in a heat-developable photosensitive material is transferred by a pump via piping without being heated to the measuring tank to undergo measurement, and subsequently melted by heating at 40° C. Comparative Examples 1 and 2 listed in Table 1 represent the conventional continuous methods for liquid preparation, wherein the silver halide emulsion is continuously melted by heating in a heating tank which is heated at 40° C. by a heating device, and the liquid preparation is carried out by continuously measuring the required amounts.

The photographic performances were investigated when the heat-developable photosensitive materials were prepared by adding the silver halide emulsions remaining after the measurements (prepared liquid residuals), both in the method for liquid preparation of the present invention and the conventional method for liquid preparation. The prepared liquid residuals in the present invention were allowed to stand at room temperature (23° C.), since the residuals were remaining either in the dedicated pot or in the piping and accordingly underwent no heating. On the other hand, the prepared liquid residuals in the conventional methods were allowed to stand at 40° C., since the residuals were remaining in the heating tank which was heated at 40° C.

The variations in photographic performance were estimated in terms of the sensitivity variations with the elapsed times observed when the silver halide emulsions of the present invention and the conventional methods were allowed to stand under the respective temperature conditions specified above. Here, the sensitivity observed before being allowed to stand is defined to be 100.

TABLE 1

| | Method for liquid preparation | Elapsed time | Sensitivity variation | Judgement |
|---|---|---|---|---|
| Example 1 | Batch-wise method of heat-melt after measurement | 8 hr | 100 | Good |
| Example 2 | Batch-wise method of heat-melt after measurement | 16 hr | 99 | Good |
| Example 3 | Batch-wise method of heat-melt after measurement | 24 hr | 98 | Good |
| Comparative example 1 | Continuous method of heat-melt before measurement | 8 hr | 93 | Poor |
| Comparative example 2 | Continuous method of heat-melt before measurement | 16 hr | 89 | Poor |

As can be seen from Table 1, the silver halide emulsion in the prepared liquid residual of the method for liquid preparation of the present invention did not show any sensitivity change for the elapsed time of 8 hr, and showed such slightly changed sensitivities as 99 and 98 for the elapsed times of 16 and 24 hr, respectively, thus being estimated to be accepted (good) without problems as the quality of a silver halide emulsion for use in a heat-developable photosensitive material.

On the contrary, the prepared liquid residual of the conventional method showed the sensitivities 93 and 89 for the elapsed times of 8 and 16 hr, respectively, and was estimated to be rejected (poor) already after 8 hr as the quality of a silver halide emulsion for use in a heat-developable photosensitive material.

The effect of the backward washing device arranged in the liquid preparation apparatus of the present invention was assessed by referring the conventional liquid preparation apparatus provided with no backward piping washing device, and the effects of the backward rotation of the mohno pump and air blowing in the backward piping washing device were investigated.

TABLE 2

| | Backward rotation of pump | Air blowing | Estimation |
|---|---|---|---|
| Test 1 | Yes | Yes | Good (no liquid residual in piping) |
| Test 2 | Yes | No | Fair (liquid residual not more than 100 g) |
| Test 3 | No | Yes | Poor (liquid residual a little more than 3500 g) |
| Test 4 | No | No | Poor (liquid residual a little more than 3500 g) |

Test 1 in Table 2 represents the case where the backward rotation of the pump and the air blowing were simultaneously applied, and the prepared liquid residual remaining in the piping could be completely recovered into the dedicated pot. On the other hand, Test 4 represents the case where the conventional apparatus for liquid preparation was used which did not have a backward washing device, and a little more than 3500 g of the silver halide emulsion remained after liquid preparation in the piping, causing the reagent loss and the mutual contamination of reagents.

tive material. The silver halide emulsions were prepared under the condition that the solution of the water soluble silver salt was added at the rates of equal to or larger than 4 kg/min. or 8 kg/min as converted to the weight of silver.

Under the test conditions shown in Table 3, investigations were made on the variation aspect of the diameters of silver halide grains with the changes of the circulating flux and addition flux, and the photographic performance of the heat-developable photosensitive material obtained by applying the prepared silver halide emulsion onto a substrate.

In the column of estimation in Table 3, the estimation of "good" signifies that the diameters of silver halide grains and the distribution width thereof were small, and the relevant photographic performance was excellent so that the test sample was accepted, the estimation of "fair" signifies that it is slightly inferior to "good" but practically there is no problem so that the test sample was accepted, and the estimation of "poor" signifies that the diameter of the silver halide grain and the distribution width thereof were large and the photographic performance was poor so that the test sample was rejected.

TABLE 3

| | Circulating flux | Addition flux | As converted to the weight of silver | Grain diameter and photographic performance | Estimation |
|---|---|---|---|---|---|
| Example 1 | 500 L/min. | 40 L/min. | 8 kg/min. | Fair as for grain diameter | Fair |
| Example 2 | 1000 L/min. | 40 L/min. | 4 kg/min. | Fair as for productivity | Fair |
| Example 3 | 1000 L/min. | 40 L/min. | 8 kg/min. | Good in all items | Good |
| Example 4 | 2000 L/min. | 40 L/min. | 8 kg/min. | Good in all items | Good |
| Example 5 | 1000 L/min. | 20 L/min. | 8 kg/min. | Fair as for grain diameter | Fair |
| Example 6 | 1000 L/min. | 30 L/min. | 8 kg/min. | Good in all items | Good |
| Comparative example 1 | 300 L/min. | 40 L/min. | 8 kg/min. | Large in grain diameter and distribution width thereof | Poor |
| Comparative example 2 | 450 L/min. | 15 L/min. | 8 kg/min. | Large in grain diameter and distribution width thereof | Poor |

As can be seen from comparison of Tests 1 to 3, the simultaneous application of the backward rotation of the pump and the air blowing gave the best results, while the backward rotation of the pump was found more effective than the air blowing as far as the recovery of a silver halide emulsion remaining in the piping is concerned, from comparison of the cases where either the backward rotation of the pump or the air blowing was applied. Accordingly, as for the constitution of the backward piping washing device, the arrangement of a mohno pump rotatable both forward and backward serves to reduce the reagent loss and is indispensable for suppression of the mutual contamination of reagents, an additional arrangement of an air blower contributing to further improvement.

(2) By referring to the specific numerical values, description will be made below on the method and apparatus for preparation of the silver halide emulsion of the present invention.

(2-1) Table 3 shows the results of testing the relations between the circulating flux, addition flux, and diameters of silver halide grains, and furthermore the photographic performance, in the preparation of a silver halide emulsion for use in a heat-developable photosensitive material.

The compositions of the solutions added in this test of silver nitrate (a water soluble silver salt) and water soluble halide were the same as those described below for the preparation of the silver halide emulsions 1 to 3 in a preferred embodiment of the heat-developable photosensi- As can be seen from comparison of the Examples and Comparative Examples, under the preparation condition that the silver halide grains were prepared by adding the solution of a water soluble silver salt at the rate equal to or larger than 4 kg/min. as converted to the weight of silver, the circulating flux smaller than 500 L/min. resulted in the larger diameters and wider distribution width of the silver halide grains, and the photographic performance, for example, the print-out performance was deteriorated.

As can be seen for comparison of Examples 3 and 5, Example 3 is better than Example 5 where the addition fluxes of the aqueous solution of silver nitrate and the solution of a water soluble halide were larger in Example 3 than in Example 5, although the value converted to the weight of silver (8 kg/min.) and the circulating flux (1000 L/min.) were the same in both Examples. In this connection, as Comparative Example 1 shows, the increase of the addition flux to the large value of 40 L/min. was not effective in combination with the circulating flux smaller than 500 L/min.

(2-2) Table 4 shows the results of testing the deactivation of sensitizing dyes by the light exposure of the present invention on the sensitizing dyes used for the silver halide emulsions for use in the heat-developable photosensitive material and the light exposure of the present invention.

The method for testing the deactivation is such that after the silver halide grain solution mixed with the sensitizing dye was discharged from the addition tank, the interior of the addition tank was rinsed once lightly with warm water, and underwent light exposure with a light exposure device. As Table 4 shows, the test was performed for the four levels of exposure time of 20 min. (Comparative Example 1), 30 min. (Example 1), 60 min.(Example 2), and 120 min. (Example 4). After the light exposure, distilled water was stored in the addition tank and stirred, so that the remaining sensitizing dye is transferred into the distilled water, and the distilled water containing the sensitizing dye was used as mother water for preparation of a different kind of emulsion. Thus, when the remaining sensitizing dye was not deactivated, the photographic performance of the different kind of emulsion was deteriorated. Accordingly, the efficiency of the light exposure for deactivating the remaining sensitizing dye was estimated through the deterioration degree of the photographic performance in the different kind of emulsion prepared as mentioned above. The photographic performance of "good" signifies that there were no problems as for the photographic performance in sensitivity and fog so that the emulsion was to be accepted, whereas the performance of "poor" signifies that there were troubles as for sensitivity and fog so that the emulsion was to be rejected.

As for Comparative Examples, similar tests were applied to the sample emulsion involving the shorter exposure time of 20 min. than the preferred exposure time of the present invention, and the sample emulsion involving only the warm-water rinsing.

TABLE 4

| | Light exposure device | Light-exposure time | Photographic performance of a different emulsion |
|---|---|---|---|
| Example 1 | Incandescent lamp (100 W) | 30 min. | Good |
| Example 2 | Incandescent lamp (100 W) | 60 min. | Good |
| Example 3 | Incandescent lamp (100 W) | 120 min. | Good |
| Comparative example 1 | Incandescent lamp (100 W) | 20 min. | Poor (occurrence of fog) |
| Comparative example 2 | Only warm-water rinsing | | Poor (occurrence of fog) |

As can be seem from the results shown in Table 4, there were no problems in photographic performance in Examples 1 to 3 where the interior of the addition tank was exposed to the light of a 100-W incandescent lamp for not shorter than 30 min. and the sample of a different kind of emulsion was prepared using the distilled water containing a sensitizing dye as the mother water. On the other hand, in Comparative Example 1 where the exposure time was 20 min., fog was found to occur as a problem in photographic performance.

Thus, it was confirmed that sensitizing dyes can be deactivated by exposing the interior of the addition tank to the light of a 100-W incandescent lamp for not shorter than 30 min.

As shown in Comparative Example 2, the warm-water rinsing alone can not rinse away the sensitizing dye remaining in the addition tank, and accordingly a conventional, simultaneous application of the cumbersome and time-consuming war-water rinsing, acid rising, and alkali rising has been found indispensable.

Next, a thermal-developable light-sensitive material preferably used in this invention will be described in detail below.

Organic silver salts that can be used in this invention are relatively stable to light; however, when heated to 80° C. or above in the presence of an exposed photocatalyst (latent image of light-sensitive silver halide and the like) and a reducer, they form silver images. The organic silver salts may be any organic substance containing a source that can reduce silver ions. Such non-light-sensitive organic silver salts are described in Japanese Patent Application Publication No. 10-62899, Paragraph Nos. 0048 and 0049; European Patent Application Publication No. 0803764A1, page 18, line 24 to page 19, line 37; European Patent Application Publication No. 0962812A1; Japanese Patent Application Publication No. 11-349591; Japanese Patent Application Publication No. 2000-7683; and Japanese Patent Application Publication No. 2000-72711. Silver salts of organic acids, and particularly preferable are the silver salts of long-chain aliphatic carboxylic acids (of which the number of carbon atoms is 10 to 30, preferably 15 to 28). Preferable examples of the organic silver salts include silver behenate, silver arachidate, silver stearate, silver oleate, silver laurate, silver capronate, silver myristate, silver palmitate, and the mixture thereof. Of these organic silver salts, the use of an organic silver salt containing 75 mol % or more silver behenate is preferable in this invention.

The form of the organic silver salts that can be used in this invention is not specifically limited, and may be needle-like, bar-like, plate-like, and flake-like.

In this invention, flake-like organic silver salts are preferable. The flake-like organic silver salts are herein defined as follows. When an organic silver salt is observed through an electron microscope, the form of a particle of the organic silver salt is approximately a rectangular parallelepiped, and when the edges of the rectangular parallelepiped are named as a, b, and c from the shortest edge (c may be the same as b), x is calculated from the shorter values a and b as follows:

$$x=b/a$$

Thus, x is calculated for about 200 particles, and when the average is called averaged value x (average), particles that satisfy the relationship of x (average)≧1.5 are defined as flake-shaped. Preferably, 30≧x (average)≧1.5, and more preferably, 20≧x (average) ≧2.0. For reference, a needle-like particle is defined as 1≦x (average)≦1.5.

In a flake-like particle, a can be deemed as the thickness of a plate-like particle that has the face having sides b and c as the principal face. The average of a is preferably 0.01 μm to 0.23 μm, and more preferably 0.1 μm to 0.20 μm. The average of c/b is preferably 1 or more and 6 or less, more preferably 1.05 or more and 4 or less, further preferably 1.1 or more and 3 or less, and most preferably 1.1 or more and 2 or less.

The distribution of the particle sizes of the organic silver salt is preferably simple distribution. Simple distribution is the distribution when the percentage of the value obtained by dividing the standard deviations of the lengths of the minor axis and the major axis by the minor axis and the major axis, respectively, is 100% or below, more preferably 80% or below, and further preferably 50% or below. The form of the organic silver salt can be measured from the transmission electron microscope image of the dispersion of the organic silver salt. Another method for measuring simple distribution is a method to calculate the standard deviation of the volume-weighted average of the organic silver salt, and the percentage of the value obtained by dividing the standard deviation by the volume-weighted average (coefficient of variation) is preferably 100% or below, more preferably 80% or below, and further preferably 50% or below. The coefficient of variation can be obtained from the particle size (volume-weighted average diameter) obtained by radiating laser beams to the organic silver salt dispersed in a liquid, and obtaining the autocorrelation function for change in time of the wobble of the scattered light.

Known methods can be applied to the method for manufacturing an organic silver salt used in this invention and to the method for dispersing it. For example, the above-described Japanese Patent Application Publication No. 10-62899, European Patent Application Publication No. 0803764A1, European Patent Application Publication No. 0962812A1; Japanese Patent Application Publication No. 11-349591; Japanese Patent Application Publication No. 2000-7683; and Japanese Patent Application Publication No. 2000-72711, Japanese Patent Application No. 11-348228, Japanese Patent Application No. 11-348229, Japanese Patent Application No. 11-348230, Japanese Patent Application No. 11-203413, Japanese Patent Application No. 2000-90093, Japanese Patent Application No. 2000-195621, Japanese Patent Application No. 2000-191226, Japanese Patent Application No. 2000-213813, Japanese Patent Application No. 2000-214155, Japanese Patent Application No. 2000-191226, and the like can be referred to.

If a light-sensitive silver salt is allowed to coexist when the organic silver salt is dispersed, fog increases and sensitivity lowers significantly; therefore, it is preferable not to substantially contain light-sensitive silver salts when the organic silver salt is dispersed. In this invention, the content of light-sensitive silver salts in the aqueous dispersion is 0.1 mol % or less to 1 mole of the organic silver salt in the dispersion, and the light-sensitive silver salts are not intentionally added.

In this invention, although a light-sensitive material can be manufactured by mixing an aqueous dispersion of an organic silver salt and an aqueous dispersion of a light-sensitive silver salt, and the mixing ratio of the organic silver salt and the light-sensitive silver salt can be selected depending on the purpose, the percentage of the light-sensitive silver salt to the organic silver salt is preferably within a range between 1 mol % and 30 mol %, more preferably within a range between 3 mol % and 20 mol %, and most preferably within a range between 5 mol % and 15 mol %. Mixing two or more aqueous dispersions of organic silver salts and two or more aqueous dispersions of light-sensitive silver salts is a method preferably used for the control of photographic performance.

Although any desired quantity of an organic silver salt can be used in this invention, the quantity as silver is preferably 0.1 $g/m^2$ to 5 $g/m^2$, and more preferably 1 $g/m^2$ to 3 $g/m^2$.

It is preferable that the thermal-developable light-sensitive material of this invention contains a reducer for organic silver salts. The reducer for organic silver salts may be any substance (preferably an organic substance) that reduces silver ions to metallic silver. Such reducers are described in Japanese Patent Application Publication No. 11-65021, paragraphs 0043 to 0045; or European Patent Application Publication No. 0803764A1, page 7, line 34 to page 18, line 12.

In this invention, a hindered phenol reducer and a bisphenol reducer are preferable as the reducer.

In this invention, the quantity of the reducer is preferably 0.01 $g/m^2$ to 5.0 $g/m^2$, and more preferably 0.1 $g/m^2$ to 3.0 $g/m^2$. For one mole of silver on the surface having an image-forming layer, the content is preferably 5 mol % to 50 mol %, and more preferably 10 mol % to 40 mol %. The reducer is preferably contained in the image-forming layer.

The reducer may be contained in the coating and therefore in the light-sensitive material in any form, such as a dissolved form, an emulsified and dispersed form, and a dispersed fine solid particle form.

One of well-known emulsifying and dispersing methods is a method wherein a reducer is dissolved in oil, such as dibutyl phthalate, tricresyl phosphate, glyceryl triacetate, and diethyl phthalate; or an auxiliary solvent, such as ethyl acetate and cyclohexanone; and then the emulsion is mechanically formed.

Fine solid particle dispersing methods include a method wherein the powder of a reducer is dispersed in a suitable solvent, such as water, using a ball mill, a colloid mill, a vibrating ball mill, a sand mill, a jet mill, a roller mill, or ultrasonic waves to form a solid dispersion. In this time, a protective colloid (for example, polyvinyl alcohol) or a surfactant (for example, an anionic surfactant, such as sodium triisopropylnaphthalenesulfate (mixture of compounds wherein three isopropyl groups are bonded to different substitution sites)) may be used. The aqueous dispersion may contain an antiseptic agent (for example, benzoisothiazolinone sodium salt).

In the thermal-developable light-sensitive material of this invention, a phenol derivative represented by equation (A) described in Japanese Patent Application No. 11-73951 is preferably used as a developing accelerator.

When the reducer in this invention has an aromatic hydroxyl group (—OH), especially in the case of the above-described bisphenols, the combined used of a non-reducing compound having groups capable of forming a hydrogen bonds with these groups is preferable. Groups that form hydrogen bonds with hydroxyl or amino groups include phosphoryl, surfoxide, sulfonyl, carbonyl, amide, ester, urethane, ureido, tertiary amino, and nitrogen-containing aromatic groups. The preferable of these are compounds having a phophoryl group, a sulfoxide group, an amide group (having no >N—H groups, and blocked as >N—Ra (Ra is a substituent other than H)), a urethane group (having no >N—H groups, and blocked as >N—Ra (Ra is a substituent other than H)), and a ureido group (having no >N—H groups, and blocked as >N—Ra (Ra is a substituent other than H)).

The particularly preferable hydrogen-bondable compound in this invention is a compound represented by the following general formula (II).

Halogen components in light-sensitive silver halides used in this invention are not specifically limited, and silver chloride, silver chlorobromide, silver bromide, silver iodobromide, and silver iodochlorobromide can be used. Of these, silver bromide and silver iodobromide are preferable. The halogen components in a silver halide particle may be evenly distributed, may change stepwise, or may change continuously. Silver halide particles having a core-and-shell structure may also be preferably used. The core-and-shell structure that can be used is preferably a two-layer to five-layer structure, and more preferably a two-layer to four-layer structure. The technique for allowing silver bromide to be locally present on the surfaces of silver chloride or silver chlorobromide particles can also be preferably used.

Methods for forming light-sensitive silver halide are well known to the skilled in the art, and the method described in Research Disclosure, No. 17029, June 1978 and U.S. Pat. No. 3,700,458 can be used. Specifically, a light-sensitive silver halide is formed by adding a silver-providing compound and a halogen-providing compound in a solution of gelatin or other polymers, and then it is mixed with an organic silver salt. Also preferably used are method described in Japanese Patent Application Publication No. 11-119374, paragraphs 0217 to 0224, and Japanese Patent Application Nos. 11-98708 and 2000-42336.

It is preferably that the particle size of the light sensitive silver halide is small for inhibiting clouding after forming images. Specifically, it is preferably 0.2 μm or smaller, more preferably 0.01 μm or larger and 0.15 μm or smaller, and most preferably 0.02 μm or larger and 0.12 μm or smaller. The term "particle size" used herein is the diameter when the projected area of a silver halide particle (in the case of plate-like particle, the projected area of the major face) is converted to the circular image of the identical area.

The shapes of the silver halide particles include cubic, octahedral, tabular, spherical, rod-like, and potato-like. In this invention, cubic particles are particularly preferable. Silver halide particles having rounded corners can also be preferably used. The plane index (Miller index) of the outer surfaces of light-sensitive silver halide particles is not specifically limited; however, it is preferable that the percentage of {100} planes, which has a high spectral sensitization efficiency when spectral sensitization dyes are adsorbed, is high. The percentage is preferably 50% or more, more preferably 65% or more, and most preferably 80% or more. The Miller index, the percentage of {100} planes, can be obtained using the method that utilizes the adsorption dependency of {111} planes and {100} planes in the adsorption of the sensitizing dyes, described in T. Tani; J. Imaging Sci., 29, 165 (1985).

In this invention, silver halide particles having a hexacyano-metal complex existing on the outermost surface thereof are preferable. The hexacyano-metal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rn(CN)_6]^{3-}$, $[Ir(CN)_6]^{3-}$, $[Cr(CN)_6]^{3-}$, and $[Re(CN)_6]^{3-}$. In this invention, a hexacyano-iron complex is preferable.

Since hexacyano-metal complexes are present in the form of ions in the aqueous solutions, the countercations are not important; however, the use of alkali-metal ions, such as sodium ions, potassium ions, rubidium ions, cesium ions, and lithium ions; ammonium ions; alkyl ammonium ions (for example, tetramethyl ammonium ions, tetraethyl ammonium ions, tetrapropyl ammonium ions, and tetra (n-butyl) ammonium ions), which are miscible with water and suitable for sedimentation of silver halide emulsions, is preferable.

The hexacyano-metal complexes can be added in the form of water, a mixture with a suitable organic solvent miscible with water (for example, alcohols, ethers, glycols, ketones, esters, amides, and the like), or gelatin.

The quantity of the hexacyano-metal complex added to 1 mole of silver is preferably $1\times10^{-5}$ mole or more and $1\times10^{-2}$ mole or less, and more preferably $1\times10^{-4}$ mole or more and $1\times10^{-3}$ mole or less.

In order to allow the hexacyano-metal complex to be present on the outermost surfaces of silver halide particles, the hexacyano-metal complex is directly added after the addition of the aqueous solution of silver nitrate used for forming particles is completed, and before the charging step up to the chemical sensitizing step for chalcogen sensitization, such as sulfur sensitization, selenium sensitization, and tellurium sensitization, or noble-metal sensitization, such as gold sensitization, is completed, that is, during the water-washing step, the dispersing step, or chemical sensitizing step. In order not to grow the silver halide particles, it is preferable to add the hexacyano-metal complex promptly after the formation of particles, and to add before the completion of the charging step.

The addition of the hexacyano-metal complex may be started after 96% by weight of the total quantity of silver nitrate is added for forming particles, and preferably after 98% by weight is added, and more preferably after 99% by weight is added.

If the hexacyano-metal complex is added after the addition of the aqueous solution of silver nitrate immediately before the completion of the formation of particles, the hexacyano-metal complex can be adsorbed on the outermost surfaces of the silver halide particles, and most of the hexacyano-metal complex reacts with silver ions to form hardly soluble salts. Since the silver salt of hexacyano iron (II) is a harder soluble salt than AgI, redissolution by fine particles can be prevented, and the particles of silver halide having a small particle size can be manufactured.

The light-sensitive silver halide particles of this invention can contain metals or metal complexes of groups 8 to 10 in the periodic table (from group 1 to group 18). The preferable metals in metals or metal complexes of groups 8 to 10 are rhodium, ruthenium, and iridium. These metal complexes may be used alone, or in combination of two or more metals of the same group or of different groups. The content is preferably within a range between $1\times10^{-9}$ mole and $1\times10^{-3}$ mole to 1 mole of the silver. These heavy metals, metal complexes, and methods for the addition thereof are described in Japanese Patent Application Publication No. 7-225449; Japanese Patent Application Publication No. 11-65021, paragraph Nos. 0018 to 0024; and Japanese Patent Application Publication No. 11-119374, paragraph Nos. 0227 to 0240.

Furthermore, metal atoms (for example, $[Fe(CN)_6]^{4-}$) that can be contained in silver halide particles used in this invention, and the desalination and chemical sensitization of silver halide emulsions are described in Japanese Patent Application Publication No. 11-84574, paragraph Nos. 0046 to 0050; Japanese Patent Application Publication No. 11-65021, paragraph Nos. 0025 to 0031; and Japanese Patent Application Publication No. 11-119374, paragraph Nos. 0242 to 0250.

Various types of gelatin can be used as the gelatin contained in the light-sensitive silver halide emulsion used in this invention. In order to maintain the dispersion of the light-sensitive silver halide emulsion in an organic-silver-salt-containing coating, the use of a low-molecular-weight gelatin of a molecular weight of 500 to 60,000 is preferable. Although such a low-molecular-weight gelatin may be used when the particles are formed, or dispersed after desalination treatment, it is preferable to use when the particles are dispersed after desalination treatment.

As a sensitizing dye that can be used in this invention, a sensitizing dye that can spectrally sensitize silver halide particles in a desired wave-length region when adsorbed on the silver halide particles, and that has a spectral sensitivity commensurate with the spectral properties of the exposing light source can be chosen advantageously. Sensitizing dyes and method for adding are described in Japanese Patent Application Publication No. 11-65021, paragraphs 0103 to 0109; a compound represented by general formula (II) in Japanese Patent Application Publication No. 10-186572; a dye represented by general formula (I) in Japanese Patent Application Publication No. 11-119374, paragraph 0106; U.S. Pat. No. 5,510,236; a dye described in Example 5 of U.S. Pat. No. 3,871,887; a dye disclosed in Japanese Patent Application Publication No. 2-96131 and No. 59-48753; European Patent Application Publication No. 0803764A1, page 19, line 38 to page 20, line 35; Japanese Patent Application Nos. 2000-86865, 2000-102560, and 2000-205399. These sensitizing dyes may be used alone, or may be used in combination of two or more dyes. In this invention, the time for adding the sensitizing dye in the silver halide emulsion is preferably after the desalination step up to application, and more preferably after the desalination step and before starting chemical aging.

Although the quantity of the sensitizing dye in this invention can be any desired quantity to meet the properties of sensitivity or fog, the quantity for 1 mole of the silver halide in the light-sensitive layer is preferably $10^{-6}$ mole to 1 mole, and more preferably $10^{-4}$ mole to $10^{-1}$ mole.

In order to improve the efficiency of spectral sensitization, a strong color sensitizer can be used in this invention. The strong color sensitizers that can be used in this invention include compounds described in European Patent Application Publication No. 587,338, U.S. Pat. Nos. 3,877,943 and 4,873,184, and Japanese Patent Application Publication Nos. 5-341432, 11-109547, and 10-111543.

It is preferable that the light-sensitive silver halide particles in this invention are chemically sensitized by sulfur sensitization, selenium sensitization, or tellurium sensitization. Compounds preferably used in sulfur sensitization, selenium sensitization, and tellurium sensitization are well known to those skilled in the art, and include, for example, a compound described in Japanese Patent Application Publication No. 7-128768. Particularly in this invention, tellurium sensitization is preferable, and the compounds described in Japanese Patent Application Publication No. 11-65021, paragraph 0030, and the compounds represented by general formulas (II), (III), and (IV) in Japanese Patent Application Publication No. 5-313284 are preferably used.

In this invention, chemical sensitization can be performed at any time after the formation of particles and before application, and specifically, it can be performed after desalination and (1) before spectral sensitization, (2) at the same time of spectral sensitization, (3) after spectral sensitization, and (4) immediately before application. In particular, it is preferable that chemical sensitization is performed after spectral sensitization.

Although the quantity of sulfur, selenium, and tellurium sensitizers used in this invention varies depending on silver halide particles used, or the conditions of chemical aging, the quantity for 1 mole of the silver halide is usually $10^{-8}$ mole to $10^{-2}$ mole, and preferably $10^{-7}$ mole to $10^{-3}$ mole. Although the conditions of chemical sensitization in this invention are not specifically limited, the pH is preferably 5 to 8, the pAg is preferably 6 to 11, and the temperature is preferably 40° C. to 95° C.

To the silver halide emulsion used in this invention, a thiosulfonate compound may be added using the method disclosed in European Patent Application Publication No. 293,917.

The light-sensitive silver halide emulsion in the light-sensitive material used in this invention can be used alone, or two or more light-sensitive silver halide emulsions (for example, of different average particle sizes, different halogen compositions, different crystal habits, or different conditions of chemical sensitization) can be used in combination. The use of a plurality of light-sensitive silver halides of different sensitivities can control the tone. These techniques are disclosed in Japanese Patent Application Publication Nos. 57-119341, 53-106125, 47-3929, 48-55730, 46-5187, 50-73627, and 57-150841. The difference in sensitivity of each emulsion is preferably 0.2 log E or more.

The quantity of the light-sensitive silver halide in terms of the quantity of applied silver for 1 $m^2$ of the light-sensitive material is preferably 0.03 $g/m^2$ to 0.6 $g/m^2$, more preferably 0.07 $g/m^2$ to 0.4 $g/m^2$, and most preferably 0.05 $g/m^2$ to 0.3 $g/m^2$. To 1 mole of the organic silver salt, the quantity of the light-sensitive silver halide is preferably 0.01 mole or more and 0.5 mole or less, and more preferably 0.02 mole or more and 0.3 mole or less.

The methods and conditions for mixing the light-sensitive silver halide and the organic silver salt separately prepared include a method for mixing the prepared silver halide particles and the organic silver salt using a high-speed agitator, a ball mill, a sand mill, a colloid mill, a vibrating mill, or a homogenizer; or a method for mixing the prepared light-sensitive silver halide in some timing during the preparation of the organic silver salt; however, the method is not limited to a specific method as long as the effect of this invention is obviously obtained. Mixing two or more aqueous dispersions of organic silver salt and two or more aqueous dispersions of light-sensitive silver salt is a preferable method for controlling photographic properties.

Although the time for adding the silver halide in a coating for image forming layers in this invention is 180 minutes before application to immediately before application, preferably 60 minutes to 10 seconds before application, a method and a condition for mixing are not specifically limited as long as the effect of this invention is obviously obtained. Specific mixing methods include a method of mixing in a tank wherein the average retention time calculated from the flow rate and the quantity to the coater is controlled to a desired time; or a method to use a static mixer described in N. Harnby, M. F. Edwards, and A. W. Nienow, "Liquid Mixing Techniques", translated by Koji Takahashi, Nikkan Kogyo Shimbun (1989), Chapter 8.

The binder of an organic-silver-salt-containing layer of this invention may be any polymer, and preferable binders are transparent or translucent, and are generally colorless. They include natural resins, polymers, and copolymers; synthetic resins, polymers, and copolymers; and other media forming films, for example, gelatins, rubbers, polyvinyl alcohols, hydroxyethyl cellulose, cellulose acetate, cellulose acetate butylate, polyvinyl pirrolidone, casein, starch, polyacrylate, polymethyl methacrylate, polyvinyl chloride, polymethacrylate, styrene-maleic anhydride copolymers, styrene-acrylonitrile copolymers, styrene-butadiene copolymers, polyvinyl acetal (for example, polyvinyl methylal and polyvinyl butylal), polyesters, polyurethane, phenoxy resins, polyvinylidene chloride, polyepoxide, polycarbonate, polyvinyl acetate, polyolefins, cellulose esters, and polyamides. The binders may also be formed by coating from water, organic solvents, or emulsions.

In this invention, the glass transition temperature of the binder for the layer containing the organic silver salt is preferably 10° C. or above and 80° C. or below (hereinafter also referred to as "high Tg binder"), more preferably 20° C. to 70° C., and most preferably 23° C. or above and 65° C. or below.

The Tg herein was calculated using the following equation.

$$1/Tg=\Sigma(Xi/Tg)$$

Here, n monomer components, from i=1 to n, are assumed to copolymerize in the polymer. Xi is the weight percentage of the i-th monomer ($\Sigma Xi=1$), and Tgi is the glass transition temperature (Kelvin) of the homopolymer of the i-th monomer. $\Sigma$ is the sum from i=1 to n. The values of the glass transition temperature of homopolymer of each monomer (Tgi) were taken from J. Brandrup and E. H. Immergurt, Polymer Handbook (3rd Edition) (Wiley-Interscience, 1989).

The polymers constituting the binder may be used alone, or used in combination of two or more as required. A polymer having a glass transition temperature of 20° C. or above may be combined with a polymer having a glass transition temperature below 20° C. When two or more polymers having different Tg are blended, it is preferable that the weight average Tg falls in the above-described range.

In this invention, the performance is improved when the organic-silver-salt-containing layer is formed by applying a coating containing a solvent whose 30% by weight or more is water, and drying; furthermore, when the binder of the organic-silver-salt-containing layer is soluble or dispersible in a water-based solvent (aqueous solvent); and particularly when the binder is composed of a polymer latex having an equilibrium moisture content at 25° C. and 60% RH of 2% by weight or less. The most preferable aspect is prepared so that the ion conductivity becomes 2.5 mS/cm or below. The methods for preparing such an aspect include purification treatment of the synthesized polymer using a membrane having an isolating function.

The water-based solvent wherein the polymer is soluble or dispersible used herein is water, or the mixture of water and 70% by weight or less water-miscible organic solvent. Water-miscible organic solvents include, for example, alcohols, such as methyl alcohol, ethyl alcohol, and propyl alcohol; cellosolves, such as methyl cellosolve, ethyl cellosolve, and butyl cellosolve; ethyl acetate; and dimethyl formamide.

In the case of a system wherein the polymer is not thermodynamically dissolved, and is present in a so-called dispersed state, the term of a water-based solvent is used here.

The "equilibrium moisture content at 25° C. and 60% RH" is represented by the following equation using the weight of the polymer W1 in a humidity-controlled equilibrium under an atmosphere of 25° C. and 60% RH, and the weight of the polymer W0 in the absolute dry condition at 25° C.

Equilibrium moisture content at 25° C. and 60% RH={(W1−W0)/W0}×100 (% by weight)

The definition and the measuring method of moisture content can be referred to, for example, Polymer Engineering Seminar 14, Methods for Testing Polymers (Society of Polymer Science, Japan, Chijin Shokan).

The equilibrium moisture content at 25° C. and 60% RH of the binder polymer of this invention is preferably 2% by weight or less, more preferably 0.01% by weight or more and 1.5% by weight or less, and most preferably 0.02% by weight or more and 1% by weight or less.

In this invention, a polymer that is dispersible in a water-based solvent is particularly preferable. Examples of dispersed states include a latex wherein fine particles of a hydrophobic polymer insoluble in water are dispersed, and a dispersion of polymer molecules in a molecular state or in a micelle state, both of which are preferable. The average particle diameter of the dispersed particles is preferably within a range between 1 nm and 50,000 nm, and more preferably within a range between 5 nm and 1,000 nm. The particle diameter distribution of the dispersed particles is not specifically limited, and the dispersed particles may have a wide particle diameter distribution or a monodisperse particle diameter distribution.

In this invention, preferred aspects of polymers dispersible in water-based solvents include hydrophobic polymers, such as acrylic polymers, polyesters, rubber (for example, SBR resin), polyurethane, polyvinyl chloride, polyvinyl acetate, polyvinylidene chloride, and polyolefins. These polymers may be straight-chain polymers, branched polymers or cross-linked polymers; may be homopolymers wherein a single type of monomers are polymerized; or may be copolymers wherein two or more types of monomers are polymerized. The copolymers may be random copolymers, or may be block copolymers. The molecular weight (number average molecular weight) of these polymers is 5,000 to 1,000,000, preferably 10,000 to 200,000. If the molecular weight is too low, the mechanical strength of the emulsion layer is insufficient; and if the molecular weight is too high, the film forming capability becomes poor.

Specific examples of preferable latexes are listed below. The list shows material monomers, the unit of values in parentheses is % by weight, and molecular weights are number average molecular weights. In the case of polyfunctional monomers, since the concept of molecular weight cannot be applied because they form cross-linked structures, they are described as "cross-linkable", and the description of molecular weights is omitted. Tg denotes glass transition temperature.

P-1; -MMA (70)-EA (27)-MAA (3)-latex (molecular weight: 37,000)

P-2; -MMA (70)-2EHA (20)-St (5)-AA (5)-latex (molecular weight: 40,000)

P-3; -St (50)-Bu (47)-MAA (3)-latex (cross-linkable)

P-4; -St (68)-Bu (29)-AA (3)-latex (cross-linkable)

P-5; -St (71)-Bu (26)-AA (3)-latex (cross-linkable, Tg 24° C.)

P-6; -St (70)-Bu (27)-IA (3)-latex (cross-linkable)

P-7; -St (75)-Bu (24)-AA (1)-latex (cross-linkable)

P-8; -St (60)-Bu (35)-DVB (3)-MAA (2)-latex (cross-linkable)

P-9; -St (70)-Bu (25)-DVB (2)-AA (3)-latex (cross-linkable)

P-10; -VC (50)-MMA (20)-EA (20)-AN (5)-AA (3)-latex (molecular weight: 80,000)

P-11; -VDC (85)-MMA (5)-EA (5)-MAA (5)-latex (molecular weight: 67,000)

P-12; -Et (90)-MMA (10)-latex (molecular weight: 12,000)

P-13; -St (70)-2EHA (27)-AA (3)-latex (molecular weight: 130,000)

P-14; -MMA (63)-EA (35)-AA (2)-latex (molecular weight: 33,000)

P-15; -St (70.5)-Bu (26.5)-AA (3)-latex (cross-linkable, Tg 23° C.)

P-16; -St (69.5)-Bu (27.5)-AA (3)-latex (cross-linkable, Tg 20.5° C.)

Abbreviations in the above-described structures denote the following monomers: MMA: methyl methacrylate, EA: ethyl acrylate, MAA: methacrylic acid, 2EHA: 2-ethylhexyl acrylate, St: styrene, Bu: butadiene, AA: acrylic acid, DVB: divinyl benzene, VC: vinyl chloride, AN: acrylonitrile, VDC: vinylidene chloride, Et: ethylene, IA: itaconic acid.

The above-described polymer latexes are also sold in the market, and the following polymers are commercially available. Examples of acrylic polymers include Cevian A-4635, 4718, and 4601 (Daicel Chemical Industries) and Nipol Lx 811, 814, 821, 820, and 857 (ZEON Corporation); examples of polyesters include FINETEX ES 650, 611, 675, and 850 (Dainippon Ink and Chemicals, Inc.) and WD-size and WMS (Eastman Chemical); examples of polyurethane include HYDRAN AP 10, 20, 30, and 40 (Dainippon Ink and Chemicals, Inc.); examples of rubbers include LACSTAR 7301K, 3307B, 4700H, and 7132C (Dainippon Ink and Chemicals, Inc.) and Nipol Lx 416, 410, 438C, and 2507 (ZEON Corporation); examples of polyvinyl chloride include G351 and G576 (ZEON Corporation); examples of polyvinylidene chloride include L502 and L513 (Asahi Kasei); and examples of polyolefins include Chemipearl S120 and SA100 (Mitsui Chemicals).

These polymer latexes may be used alone, or may be used in combination of two or more as required.

The polymer latex preferably used in this invention is latex of a styrene-butadiene copolymer. The weight ratio of styrene monomer units to butadiene monomer units in the styrene-butadiene copolymer is preferably 40:60 to 95:5. The proportion of styrene monomer units and butadiene monomer units in the copolymer is preferably 60% by weight to 99% by weight. The preferable molecular weight range is the same as described above.

Latexes of styrene-butadiene copolymers preferably used in this invention include the above-described P-3 to P-8, P-14, P-15, commercially available LACSTAR-3307B, 7132C, and Nipol Lx 416.

In the organic-silver-salt-containing layer of the light-sensitive material of this invention, hydrophilic polymers, such as gelatin, polyvinyl alcohol, methylcellulose, hydroxypropyl cellulose, and carboxymethyl cellulose may be added as required. The content of these hydrophilic polymers in the total quantity of binders in the organic-silver-salt-containing layer is preferably 30% by weight or less, and more preferably 20% by weight or less.

The organic-silver-salt-containing layer (image forming layer) of this invention is preferably formed from polymer latex. The weight ratio of the total quantity of the binder to the organic silver salt in the organic-silver-salt-containing layer is within a range between 1/10 and 10/1, preferably 1/5 and 4/1.

Such an organic-silver-salt-containing layer is normally a light-sensitive layer (emulsion layer) containing light-sensitive silver halide, which is a light-sensitive silver salt, and in this case, the weight ratio of total binders to the silver halide is within a range between 400 and 5, preferably 200 to 10.

The total quantity of the binder in the image-forming layer of this invention is within a range between 0.2 $g/m^2$ and 30 $g/m^2$, preferably between 1 $g/m^2$ and 15 $g/m^2$. In the image-forming layer of this invention, a cross-linking agent for cross-linking, and a surfactant for improving applying properties may be added.

In this invention, the solvent (here, a solvent and a dispersant are collectively referred to as solvent for simplification) in the coating for the organic-silver-salt-containing layer of the light-sensitive layer in this invention is preferably a water-based solvent containing 30% by weight or more water. The components other than water may be any optional water-miscible organic solvents, such as methyl alcohol, ethyl alcohol, isopropyl alcohol, methyl cellosolve, ethyl cellosolve, dimethyl formamide and ethyl acetate. The water content in the solvent of the coating is preferably 50% by weight or more, and more preferably 70% by weight or more. The preferable examples of solvent compositions are water, water/methyl alcohol=90/10, water/methyl alcohol=70/30, water/methyl alcohol/dimethyl formamide=80/15/5, water/methyl alcohol/ethyl cellosolve=85/10/5, and water/methyl alcohol/isopropyl alcohol=85/10/5 (unit: % by weight).

The anti-fog agent, stabilizer, and precursor for the stabilizer that can be used in this invention include compounds described in Japanese Patent Application Publication No. 10-62899, paragraph 0070, European Patent Application Publication No. 0803764A1, page 20, line 57 to page 21, line 7, and Japanese Patent Application Publication Nos. 9-281637 and 9-329864. The anti-fog agents preferably used in this invention are organic halogen compounds, and are disclosed in Japanese Patent Application Publication No. 11-65021, paragraphs 0111 to 0112. The organic halogen compounds represented by formula (P) of Japanese Patent Application No. 11-87297, the organic polyhalogen compound represented by general formula (II) of Japanese Patent Application Publication No. 10-339934, and the organic polyhalogen compounds described in Japanese Patent Application No. 11-205330 are particularly preferable.

The organic polyhalogen compounds preferably used in this invention will specifically be described below. The preferable polyhalogen compounds are compounds represented by the following general formula (III).

$$Q\text{-}(Y)n\text{-}C(Z1)(Z2)X \qquad \text{General formula (III)}$$

In general formula (III), Q represents an alkyl group, aryl group, or heterocyclic group; Y represents a divalent coupling group; n represents 0 or 1; Z1 and Z2 represent halogen atoms; and X represents a hydrogen atom or an electron-attracting group. In general formula (III), Q is preferably a phenyl group substituted by an electron-attracting group whose Hamett substituent constant op is positive. The Hamett substituent constant is described in Journal of Medicinal Chemistry, 1973, Vol. 16, No. 11, pp. 1207–1216. Such electron-attracting groups include, for example, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), cyano group (σp value: 0.66), nitro group (σp value: 0.78), aliphatic aryl or heterocyclic sulfonyl groups (for example, methane sulfonyl (σp value: 0.72)), aliphatic aryl or heterocyclic acyl groups (for example, acetyl (σp value: 0.50), benzoyl (σp value: 0.43)), alkynyl groups (for example, C≡CH (σp value: 0.23)), aliphatic aryl or heterocyclic oxycarbonyl groups (for example, methoxy carbonyl (σp value: 0.45), phenoxy carbonyl (σp value: 0.44)), carbamoyl group (σp value: 0.36), sulfamoyl groups (σp value: 0.57), sulfoxide groups, heterocyclic groups, and phosphoryl groups. The σp value is preferably within a range between 0.2 and 2.0, more preferably within a range between 0.4 and 1.0. Particularly preferable electron-attracting groups are carbamoyl, alkoxycarbonyl, alkylsulfonyl, and alkylphosphoryl groups, of which the most preferable is the carbamoyl group.

X represents preferably an electron-attracting group, more preferably a halogen atom, an aliphatic aryl or heterocyclic sulfonyl group, an aliphatic aryl or heterocyclic acyl group, an aliphatic aryl or heterocyclic oxycarbonyl group, a carbamoyl group, and a sulfamoyl group, and particularly preferably a halogen atom. Among halogen atoms, a chlorine atom, bromine atom, and iodine atom are preferable; a chlorine atom and bromine atom are more preferable; and a bromine atom is most preferable.

Y represents preferably —C(═O)—, —SO—, or —$SO_2$—, more preferably —C(═O)— or —$SO_2$—, and most preferably —$SO_2$—, n represents 0 or 1, preferably 1.

In this invention, the methods for containing an anti-fog agent in the light-sensitive material include the method described in the above-described method for containing the reducer, and the addition of fine solid particles is also preferable for the organic polyhalogen compound.

Other anti-fog agents include the mercury (II) salt in Japanese Patent Application Publication No. 11-65021, paragraph 0113, benzoates in Japanese Patent Application Publication No. 11-65021, paragraph 0114, salicylic acid derivatives in Japanese Patent Application Publication No. 2000-206642, formalin scavenger compounds represented by formula (S) in Japanese Patent Application Publication No. 2000-221634, triazine compounds according to claim 9 of Japanese Patent Application Publication No. 11-352624, the compounds represented by general formula (III) of Japanese Patent Application Publication No. 6-11791, and 4-hydroxy-6-methyl-1,3,3a,7-tetrazaindene.

The thermal-developable light-sensitive material of this invention may contain an azolium salt for the purpose of preventing fog. The azolium salts include the compounds represented by general formula (XI) described in Japanese Patent Application Publication No. 59-193447, the compound described in Japanese Patent publication No. 55-12581, and the compounds represented by general formula (II) described in Japanese Patent Application Publication No. 60-153039. Although the azolium salt can be added to any positions in the light-sensitive material, addition to the layer on the surface having the light-sensitive layer is preferable, and addition to the organic-silver-salt-containing layer is more preferable. Although the azolium salt can be added in any steps for the preparation of the coating, and when it is added to the organic-silver-salt-containing layer, it can be added in any steps from the time for the preparation of the organic silver salt to the preparation of the coating, and preferably the time after the preparation of the organic silver salt to immediately before applying. The azolium salt may be added in any forms, such as powder, a solution, and a dispersion of fine particles. It may also be added as a solution whereto other additives, such as a sensitizing dye, a reducer, and toning agent, are added. In this invention, although the quantity of the azolium salt to be added may be optional, it is preferably $1\times10^{-6}$ mole or more and 2 moles or less, and more preferably $1\times10^{-3}$ mole or more and 0.5 moles or less to 1 mole of silver.

In this invention, a mercapto compound, a disulfide compound, and a thion compound may be contained for inhibiting, accelerating, or controlling development; for improving the efficiency of spectral sensitization; and for improving storage stability before and after development. The specific examples are described in Japanese Patent Application Publication No. 10-62899, paragraphs 0067 to 0069; the compounds represented by general formula (I) of Japanese Patent Application Publication No. 10-186572, and paragraphs 0033 to 0052; European Patent Application Publication No. 0803764A1, page 20, lines 36 to 56; and Japanese Patent Application No. 11-273670. Above all, a mercapto-substituted heterocyclic aromatic compound is preferable.

In the thermal-developable light-sensitive material of this invention, the addition of a toning agent is preferable. Toning agents are described in Japanese Patent Application Publication No. 10-62899, paragraph Nos. 0054 and 0055; European Patent Application Publication No. 0803764A1, page 21, lines 23 to 48; Japanese Patent Application Publication No. 2000-356317; and Japanese Patent Application No. 2000-187298. Particularly preferable are phthaladinones (phthaladinone, phthaladinone derivatives, or metal salts; for example, 4-(1-naphthyl) phthaladinone, 6-chlorophthaladinone, 5,7-dimethoxyphthaladinone, and 2,3-dihydro-1,4-phthaladinedione); the combination of phthaladinones and phthalates (for example, phthalic acid, 4-methyl phthalic acid, 4-nitro phthalic acid, diammonium phthalate, sodium phthalate, potassium phthalate, and tetrachloro phtalic anhydride); phthaladines (phthaladine, phthaladine derivatives, or metal salts; for example, 4-(1-naphthyl) phthaladine, 6-isopropyl phthaladine, 6-t-butyl phthaladine, 6-chloro phthaladine, 5,7-dimethoxy phthaladine, and 2,3-dihydro phthaladine); and the combination of phthaladines and phthalates. Of these, the combination of phthaladines and phthalates is most preferable.

Plasticizers and lubricants that can be used in the light-sensitive layers of this invention are described in Japanese Patent Application Publication No. 11-65021, paragraph 0117; the super-high contract agents for forming super-high contract images, and the method of addition and quantity thereof are described in Japanese Patent Application Publication No. 11-65021, paragraph 0118; Japanese Patent Application Publication No. 11-223898, paragraphs 0136 to 0193; Japanese Patent Application No. 11-87297, compounds of formulas (H), (1) to (3), (A), and (B); Japanese Patent Application No. 11-91652, compounds of general formulas (III) to (V) (specific compounds: compounds 21 to 24); and high-contrast promoters are described in Japanese Patent Application Publication No. 11-65021, paragraph 0102, and Japanese Patent Application Publication No. 11-223898, paragraphs 0194 and 0195.

In order to use formic acid or a formate as a strong fogging substance, it is preferably contained in the side having an image-forming layer that contains the light-sensitive silver halide in a quantity of 5 mmol or less for 1 mole of silver, more preferably 1 mmol or less.

When an ultra-high contrast agent is used in the thermal-developable light-sensitive material of this invention, it is preferable to use in combination with an acid or the salt thereof formed by hydrating diphosphorus pentaoxide. The acids or the salts thereof formed by hydrating diphosphorus pentaoxide include metaphosphoric acid (metaphosphorates), pyrophosphoric acid (pyrophosphorates), orthophosphoric acid (orthophosphorates), triphosphoric acid (triphosphorates), tetraphosphoric acid (tetraphosphorates), and hexametaphosphoric acid (hexametaphosphorates). Particularly preferable acids or the salts thereof formed by hydrating diphosphorus pentaoxide are orthophosphoric acid (orthophosphorates), and hexametaphosphoric acid (hexametaphosphorates). Specific salts include sodium orthophosphorate, dihydrogen sodium orthophosphorate, sodium hexametaphosphorate, and ammonium hexametaphosphorate.

Although the quantity (applying quantity for 1 $m^2$ of the light-sensitive material) of acids or the salts thereof formed by hydrating diphosphorus pentaoxide may be as desired depending on the performance, such as sensitivity and fog, it is preferably 0.1 $mg/m^2$ to 500 $mg/m^2$, and more preferably 0.5 $mg/m^2$ to 100 $mg/m^2$.

The thermal-developable light-sensitive material of this invention may have a surface-protecting layer for the purpose of preventing the adherence of the image-forming layer. The surface-protecting layer may be of a single layer, or may be of multiple layers. The surface-protecting layer is described in Japanese Patent Application Publication No. 11-65021, paragraphs 0119 to 0120, and Japanese Patent Application No. 2000-171936.

Although gelatin is preferably used for the binder of the surface-protecting layer of this invention, it is also preferable to use or to combine polyvinyl alcohol (PVA). Gelatin that can be used include inert gelatin (for example, Nitta Gelatin 750) and phthalated gelatin (for example, Nitta Gelatin 801). PVA that can be used is described in Japanese Patent Application Publication No. 2000-171936, paragraphs 0009 to 0020, and fully saponified PVA-105, partially saponified PVA-205, PVA-335, and modified polyvinyl alcohol MP-203 (KURARAY) are preferably used. The quantity of polyvinyl alcohol applied to the protecting layer (per layer) (per 1 $m^2$ of the support) is preferably 0.3 $g/m^2$ to 4.0 $g/m^2$, and more preferably 0.3 $g/m^2$ to 2.0 $g/m^2$.

Particularly, when the thermal-developable light-sensitive material of this invention is used for printing, wherein change in dimensions raises problems, the use of polymer latex in the surface-protecting layer or the backing layer is preferable. Such polymer latexes are described in Taira Okuda and Hiroshi Inagaki, "Synthetic Resin Emulsion", Kobunshi Kankoukai (1978); Takaaki Sugimura, Yasuo Kataoka, Soichi Suzuki, and Keiji Kasahara, "Application of Polymer Latex", Kobunshi Kankoukai (1993); and Soichi Muroi, "Chemistry of Polymer Latex", Kobunshi Kankoukai (1970). Specifically, the polymer latexes include a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer; a latex of ethyl acrylate/metacrylic acid copolymer;a latex of methyl methacrylate (58.9% by weight)/2-etylhexyl acrylate (25.4% by weight)/styrene (8.6% by weight)/2-hydroxyethyl methacrylate (5.1% by weight)/acrylic acid (2.0% by weight) copolymer, and a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer. Furthermore, the combination of polymer latexes described in Japanese Patent Application No. 11-6872, the technique described in Japanese Patent Application No. 11-143058, paragraphs 0021 to 0025; the technique described in Japanese Patent Application No. 11-6872, paragraphs 0027 to 0028; and the technique described in Japanese Patent Application No. 10-199626, paragraphs 0023 to 0041 can be applied to binders for surface-protecting layer. The content of the polymer latex for surface-protectiing layer is preferably 10% by weight to 90% by weight of the total binder, more preferably 20% by weight to 80% by weight.

The quantity of the total binders (including water-soluble polymers and latex polymers) of the surface-protecting layer (per layer) (per 1 $m^2$ of the support) is preferably 0.3 $g/m^2$ to 5.0 $g/m^2$, and more preferably 0.3 $g/m^2$ to 2.0 $g/m^2$.

The temperature in the preparation of the coating for the image-forming layer in this invention is 30° C. or above and 65° C. or below, preferably 35° C. or above and below 60° C., and more preferably 35° C. or above and 55° C. or below. It is also preferable that the temperature of the coating for the image-forming layer immediately after the addition of polymer latex is maintained at 30° C. or above and 65° C. or below.

The image-forming layer of this invention is composed of one or more layer on the support. When it is composed of one layer, the layer comprises an organic silver salt, light-sensitive silver halide, a reducer, and a binder, and as required, contains additional materials, such as a toning agent, covering additives and other auxiliary agents. When it is composed of two or more layers, the first image-forming layer (normally the layer contacting the support) must contain an organic silver salt and light-sensitive silver halide, and the second image-forming layer or both layers must contain other several components. The constitution of a multicolor light-sensitive thermal-developable photographic material may contain the combination of these two layers for each color, and all the components may be contained in a single layer, as described in U.S. Pat. No. 4,708,928. In the case of a multi-dye multicolor light-sensitive thermal-developable photographic material, each emulsion layer is separated from each other and maintained by using a functional or non-functional barrier layer between each light-sensitive layer, as described in U.S. Pat. No. 4,460,681.

Various dyes or pigments (for example, C. I. Pigment Blue 60, C. I. Pigment Blue 64, and C. I. Pigment Blue 15:6) can be used in the light-sensitive layer of this invention from the pint of view of improving color tone, preventing the occurrence of interference fringes in exposing a lazer beam, and preventing irradiation. These are described in WO 98/36322, and Japanese Patent Application Publication Nos. 10-268465 and 11-338098.

In the thermal-developable light-sensitive material of this invention, an anti-halation layer can be provided on the side of light-sensitive layer remote from the light source.

A thermal-developable light-sensitive material has generally non-light-sensitive layers in addition to a light-sensitive layer. Non-light-sensitive layers can be classified according to the location thereof into (1) a protecting layer provided on the light-sensitive layer (remote side from the support), (2) an intermediate layer provided between a plurality of light-sensitive layers or between the light-sensitive layer and the protecting layer, (3) a primer layer provided between the light-sensitive layer and the support, and (4) a backing layer provided on the side opposite to the light-sensitive layer. A filter layer is provided on the light-sensitive layer as the layer (1) or (2). The anti-halation layer is provided on the light-sensitive layer as the layer (3) or (4).

Anti-halation layers are described in, for example, Japanese Patent Application Publication No. 11-65021, paragraphs 0123 and 0124; Japanese Patent Application Publication Nos. 11-223898, 9-230531, 10-36695, 10-104779, 11-231457, 11-352625, and 11-352626.

The anti-halation layer contains an anti-halation dye having absorption in the exposure wavelength. When the exposure wavelength is in the infrared region, an infrared absorbing dye can be used, and in this case, the dye that has no absorption in the visible region is preferable.

If halation is prevented using a dye having absorption in the visible region, it is preferable that the color of the dye does not substantially remain after forming images, a means to vanish the color with the heat of thermal development is used, and in particular, a thermally achromatizing dye and a base precursor are added to a non-light-sensitive layer to function as an anti-halation layer. These techniques are described in Japanese Patent Application Publication No. 11-231457.

The quantity of the achromatizing dye is determined according to the use of the dye. In general, it is used in a quantity that the optical density (absorbance) measured by the objective wavelength exceeds 0.1. The optical density is preferably 0.2 to 2. The quantity of the dye for obtaining such an optical density is generally approximately 0.001 $g/m^2$ to 1 $g/m^2$.

When the dye is achromatized, the optical density after thermal development can be lowered to 0.1 or less. Two or more achromatizing dyes may be used in combination in a thermally achromatizing recording material or a thermal-developable light-sensitive material. Similarly, two or more base precursors may be used in combination.

In thermal achromatizing using such achromatizing dyes and base precursors, the combination use of a substance that lowers the melting point by 3 degrees or more by mixing with a base precursor such as described in Japanese Patent Application Publication No. 11-352626 (for example, diphenylsulfone and 4-chlorophenyl (phenyl) sulfone) is preferable from the point of view of thermal achromatizing.

In this invention, for the purpose of improving change by aging of the silver color tone and the images, a colorant having an absorption maximum at 300 nm to 450 nm can be added. Such a colorant is described, for example, in Japanese Patent Application Publication Nos. 62-210458, 63-104046, 63-103235, 63-208846, 63-306436, 63-314535, 01-61745, and Japanese Patent Application No. 11-276751. Such a colorant is normally added within a range between 0.1 mg/m$^2$ and 1 mg/m$^2$, and the layer for the addition of the colorant is preferably the back layer provided opposite to the light-sensitive layer.

The thermal-developable light-sensitive material in this invention is preferably a one-sided light-sensitive material having at least one light-sensitive layer containing a silver halide emulsion on one side of the support, and having a backing layer on the other side.

In this invention, it is preferable to add a mat agent for improving conveying properties, and the mat agent is described in Japanese Patent Application Publication No. 11-65021, paragraphs 0126 to 0127. The quantity of the mat agent applied to 1 m$^2$ of the light-sensitive material is preferably 1 mg/m$^2$ to 400 mg/m$^2$, and more preferably 5 mg/m$^2$ to 300 mg/m$^2$.

Although any mat degree of the emulsion surface is optional unless stardust defects occur, the Peck flatness is preferably 30 seconds or more and 2,000 seconds or less, and more preferably 40 seconds or more and 1,500 seconds or less. The Peck flatness can be obtained in accordance with Japanese Industrial Standards (JIS) P8119, "Method for Testing Flatness of Paper and Cardboard Using Peck Tester", and TAPPI Standard Method T479.

In this invention, the Peck flatness for a mat degree of the backing layer is preferably 1,200 seconds or less and 10 seconds or more, more preferably 800 seconds or less and 20 seconds or more, and most preferably 500 seconds or less and 40 seconds or more.

In this invention, the matting agent is preferably contained in the outermost surface layer of the light-sensitive layer or a layer that functions as the outermost surface layer, a layer close to the outer surface, or a layer that functions as the protecting layer.

The backing layer that can be applied to this invention is described in Japanese Patent Application Publication No. 11-65021, paragraphs 0128 to 0130.

The pH of the film surface of the thermal-developable light-sensitive material before thermal development in this invention is preferably 7.0 or lower, and more preferably 6.6 or lower. Although the lower limit thereof is not specifically limited, it is about 3. The most preferable pH range is between 4 and 6.2. The control of the pH of the film surface using an organic acid such as phthalic acid derivatives, a non-volatile acid such as sulfuric acid, or a volatile base such as ammonia is preferable from the point of view of lowering the pH of the film surface. In particular, since ammonia is easily evaporated and can be removed before the applying step or thermal development, it is preferable for achieving a low pH of the film surface.

The combined use of a non-volatile base, such as sodium hydroxide, potassium hydroxide, and lithium hydroxide, with ammonia is also preferable. A method for measuring the pH of the film surface is described in Japanese Patent Application No. 11-87297, paragraph 0123.

In the layers of this invention, such as light-sensitive layer, the protecting layer, and the backing layer, a hardener can be used. Examples of hardeners include methods described in T. H. James, "The Theory of the Photographic Process, Fourth Edition", Macmillan Publishing Co. Inc, (1977), pages 77 to 87; and chrome alum, 2,4-dichloro-6-hydroxy-s-triazine sodium salt, N,N-ethylene bis(vinylsulfone acetamide), and N,N-propylene bis(vinylsulfone acetamide); as well as multivalent metal ions described in page 78 of the same reference book; polyisocyanates described in U.S. Pat. No. 4,281,060 and Japanese Patent Application Publication No. 6-208193; epoxy compounds described in U.S. Pat. No. 4,791,042; and vinylsulfone-based compounds described in Japanese Patent Application Publication No. 62-89048 are preferably used.

The hardener is added in the form of a solution, and the time for adding the solution to the coating for the protecting layer is 180 minutes before to immediately before applying, preferably 60 minutes to 10 seconds before applying. The methods and conditions for mixing is not specifically limited as long as the effect of the invention is sufficiently achieved. Specific methods for mixing include a method of mixing in a tank wherein the average retention time calculated from the flow rate and the quantity to the coater is controlled to a desired time; or a method to use a static mixer described in N. Harnby, M. F. Edwards, and A. W. Nienow, "Liquid Mixing Techniques", translated by Koji Takahashi, Nikkan Kogyo Shimbun (1989), Chapter 8.

The surfactants, the solvent, the support, the anti-static or conductive layer, and the method for obtaining color images that can be used in this invention are disclosed in Japanese Patent Application Publication No. 11-65021, paragraph 0132, 0133, 0134, 0135, and 0136, respectively; and the lubricants are described in Japanese Patent Application Publication No. 11-84573, paragraphs 0061 to 0064, and Japanese Patent Application No. 11-106881, paragraphs 0049 to 0062.

For a transparent support, polyester, especially polyethylene terephthalate undergone heat treatment within a temperature range between 130° C. and 185° C. is preferably used for relieving internal strain remaining in the film during biaxial drawing, and eliminating thermal shrinkage strain occurring during thermal development. In the case of a thermal-developable light-sensitive material, the transparent support may be colored with a blue dye (for example, dye-1 described in Japanese Patent Application Publication No. 8-240877), or may be not colored. It is preferable that the primer techniques of water-soluble polyester described in Japanese Patent Application Publication No. 11-84574, styrene-butadiene copolymer described in Japanese Patent Application Publication No. 10-186565, and vinylidene chloride copolymers described in Japanese Patent Application Publication No. 2000-39684 and Japanese Patent Application No. 11-106881, paragraphs 0063 to 0080 are applied to the support. To the antistatic layers or the primers, the techniques described in Japanese Patent Application Publication Nos. 56-143430, 56-143431, 58-62646, 56-120519, and 11-84573, paragraphs 0040 to 0051, U.S. Pat. No. 5,575,957, and Japanese Patent Application Publication No. 11-223898, paragraphs 0078 to 0084 can be applied.

The thermal-developable light-sensitive material is preferably of a monosheet type (a type that can form images on a thermal-developable light-sensitive material not using other sheets as in image-receiving materials).

To the thermal-developable light-sensitive material, an anti-oxidant, a stabilizer, a plasticizer, a ultraviolet absorber, or coating additives may further be added. The various additives are added to either the light-sensitive layer or a non-light-sensitive layer. These are described in WO 98/36322, EP 803764A1, Japanese Patent Application Publication Nos. 10-186567 and 10-18568.

The thermal-developable light-sensitive material in this invention can be applied using any methods. Specifically, various coating operations can be used, including extrusion coating, slide coating, curtain coating, dip coating, knife coating, flow coating, and extrusion coating using a hopper of a type described in U.S. Pat. No. 2,681,294. Extrusion coating described in Stephen F. Kistler, Petert M. Schweizer, "Liquid Film Coating", (Chapman & Hall, 1997), pages 399 to 536, or slide coating are preferably used, and slide coating is most preferably used. An example of a form of slide coaters used for slide coating is shown in FIG. 11b.1 in page 427 of the above-described reference. If desired, two or more layers can be coated simultaneously using the methods described in pages 399 to 536 of the above-described reference, U.S. Pat. No. 2,761,791, and British Patent No. 837,095.

The organic-silver-salt-containing coating in this invention is preferably a so-called thixotropic fluid. This technique is described in Japanese Patent Application Publication No. 11-52509. The viscosity at a shear rate of 0.1 $s^{-1}$ of the coating is preferably 400 mPa·s or more and 100,000 mPa·s or less, and more preferably 500 mPa·s or more and 200,000 mPa·s or less. The viscosity at a shear rate of 1000 $s^{-1}$ is preferably 1 mPa·s or more and 200 mPa·s or less, and more preferably 5 mPa·s or more and 80 mPa·s or less.

Techniques that can be used in the thermal-developable light-sensitive material of this invention are also described in EP 803764A1, EP 883022A1, WO 98/36322, Japanese Patent Application Publication Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569, 10-186570, 10-186571, 10-186572, 10-197974, 10-197982, 10-197983, 10-197985, 10-197986, 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536, 11-133537, 11-133538, 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, Japanese Patent Application Nos. 2000-187298, 2000-10229, 2000-47345, 2000-206642, 2000-98530, 2000-98531, 2000-112059, 2000-112060, 2000-112104, 2000-112064, 2000-171936, and 11-282190.

The thermal-developable light-sensitive material of this invention may be developed using any methods, and normally, it is developed by heating the thermal-developable light-sensitive material exposed image-wise. The developing temperature is preferably 80° C. to 250° C., and more preferably 100° C. to 140° C. The developing time is preferably 1 second to 60 seconds, more preferably 5 seconds to 30 seconds, and most preferably 10 seconds to 20 seconds.

The preferable system for thermal development is a plate-heater system. The preferable thermal development system by a plate-heater system is a system described in Japanese Patent Application Publication No. 11-133572, which is a thermal development system for obtaining visible images by contacting a thermal-developable light-sensitive material wherein a latent image has been formed with a heating means in the thermal development section. The thermal development system is characterized in that the heating means comprises a plate heater, a plurality of presser rollers are disposed facing and along a surface of the plate heater, and the thermal-developable light-sensitive material is passed between the presser rollers and the plate heater to perform thermal development. It is preferable that the plate heater is divided into two to six stages, and that the temperature of the end portion is lowered by 1 to 10° C. Such a method, also described in Japanese Patent Application Publication No. 54-30032, can exclude moisture or organic solvents contained in the thermal-developable light-sensitive material out of the system, and the deformation of the support of the thermal-developable light-sensitive material suddenly heated can be prevented.

Although the light-sensitive material of this invention can be exposed using any methods, a preferable light source for exposure is laser beams. The preferable laser beams for this invention include gas laser ($Ar^+$, He—Ne), YAG laser, dye laser, and semiconductor laser. A semiconductor laser and a second higher-harmonic-generating element can also be used. Red to infrared emitting gas or a semiconductor laser is preferable.

Laser imagers for medical use having an exposure section and a thermal development section include Fuji Medical Dry Laser Imager FM-DP L. The FM-DP L is described in Fuji Medical Review No. 8, pages 39 to 55, and these techniques can be applied to the laser imager of the thermal-developable light-sensitive material of this invention. These techniques can also be applied to the thermal-developable light-sensitive material for the laser imager in "AD network" proposed by Fuji Medical System as a network system meeting the DICOM Standards.

The thermal-developable light-sensitive material of this invention forms black-and-white images by silver images, and is preferably used in the thermal-developable light-sensitive material for medical diagnostics, the thermal-developable light-sensitive material for industrial photography, the thermal-developable light-sensitive material for printing, and the thermal-developable light-sensitive material for COM.

(Fabrication of PET Support)

Using terephthalic acid and ethylene glycol, PET having an intrinsic viscosity (IV) of 0.66 (measured in a mixed solvent of phenol and tetrachloroethane (6:4 by weight) at 25° C.) was obtained according to a normal method. This was palletized, dried at 130° C. for 4 hours, melted at 300° C., extruded through a T-die, and quenched to form a non-oriented film of a thickness after heat fixing of 175 μm.

This film was longitudinally stretched 3.3 times using rolls of different circumferential speed, and transversally stretched 4.5 times using a tenter. The temperatures for stretching were 110° C. and 130° C., respectively. Thereafter, the film was heat-fixed at 240° C. for 20 seconds, and relaxed by 4% in the transverse direction at the same temperature. Then, the portion of the film held by the chuck of the tenter was cut off, the both edges were knurled, the film was wound at 4 kg/$cm^2$ to obtain a roll of the film having a thickness of 175 μm.

(Corona Treatment of Surface)

The both surfaces of the support were treated using a 6-kVA solid-state corona treatment system of Piller Inc. at room temperature at 20 m/min. From the readings of current and voltage, it was known that the support was treated at 0.375 kV·A·min/$m^2$. The treatment frequency was 9.6 kHz, and the gap clearance between the electrode and the dielectric roller was 1.6 mm.

(Fabrication of Primer Coating Support)

(1) Preparation of Primer

| Formulation (for primer-coated layer in the light-sensitive layer side) | |
|---|---|
| Pesresin A-515GB (30% by weight solution) (Takamatsu Oil & Fat) | 234 g |
| Polyethylene glycol monononyl phenyl ether (average ethylene oxide number = 8.5) (10% by weight solution) | 21.5 g |
| MP-1000 (Soken Chemical & Engineering) (polymer fine particles, average particle diameter: 0.4 μm) | 0.91 g |
| Distilled water | 744 mL |
| Formulation (for first layer in back surface) | |
| Styrene-butadiene copolymer latex (solid content: 40% by weight, styrene/butadiene weight ratio: 68/32) | 158 g |
| 2,4-dichloro-6-hydroxy-S-triazine, sodium salt (8% by weight aqueous solution) | 20 g |
| Sodium laurylbenzenesulfonate (1% by weight aqueous solution) | 10 mL |
| Distilled water | 854 mL |
| Formulation (for second layer in back surface) | |
| $SnO_2/SbO$ (9/1 weight ratio, average particle diameter: 0.038 μm, 17 weight % dispersion) | 84 g |
| Gelatin (10% by weight aqueous solution) | 89.2 g |
| Metolose TC-5 (2% by weight aqueous solution) (Shin-Etsu Chemical) | 8.6 g |
| MP-1000 (Soken Chemical & Engineering) | 0.01 g |
| Sodium dodecylbenzene sulfonate (1% by weight aqueous solution) | 10 mL |
| NaOH (1% by weight) | 6 mL |
| Prokicell (ICI) | 1 mL |
| Distilled water | 805 mL |

(Fabrication of Primer Coated Support)

After the both surfaces of the above-described biaxially oriented polyethylene terephthalate support having a thickness of 175 μm was subjected to the above-described corona discharge treatment, the primer of the above-described formulation was applied to one surface (light-sensitive layer side) with a wire bar so that the wet applied quantity became 6.6 mL/m$^2$ (per surface), and dried at 180° C. for 5 minutes. Then, the primer of above-described formulation was applied to the other surface (back face) with a wire bar so that the wet applied quantity became 5.7 mL/m$^2$, and dried at 180° C. for 5 minutes. Furthermore, the primer of above-described formulation was applied to the other surface (back face) with a wire bar so that the wet applied quantity became 7.7 mL/m$^2$, and dried at 180° C. for 6 minutes to fabricate a primer coated support.

(Preparation of Back-Face Coating)

(Preparation of Fine Solid Particle Dispersion (a) of Basic Precursor)

With 220 mL of distilled water, 64 g of the basic precursor compound 11, 28 g of diphenyl sulfone, and 10 g of Demol N (surfactant, Kao Corp.) were mixed, and the mixture was subjected to bead dispersion using a sand mill (¼-gallon sand grinder mill, Aimex) to form a fine solid particle dispersion (a) of the basic precursor having an average particle diameter of 0.2 μm.

(Preparation of Fine Solid Particle Dispersion of Dye)

With 305 mL of distilled water, 9.6 g of cyanine dye compound 13 and 5.8 g of sodium p-dodecylbenzenesulfonate were mixed, and the mixture was subjected to bead dispersion using a sand mill (¼-gallon sand grinder mill, Aimex) to form a fine solid particle dispersion of the dye having an average particle diameter of 0.2 μm.

(Preparation of Anti-Halation Coating)

Seventeen grams of gelatin, 9.6 g of polyacrylamide, 70 g of the above-described fine solid particle dispersion (a) of the basic precursor, 56 g of the above-described fine solid particle dispersion of the dye, 1.5 g of fine particles of monodisperse polymethyl methacrylate (average particle size: 8 μm, standard deviation of particle diameters: 0.4), 0.03 g of benzoisothiazolinone, 2.2 g of sodium polyethylenesulfonate, 0.2 g of blue dye compound 14, 3.9 g of yellow dye compound 15, and 844 mL of water were mixed to prepare an anti-halation coating.

(Preparation of Back Face Protecting Coating)

A container was maintained at a temperature of 40° C., 50 g of gelatin, 0.2 g of sodium polystyrenesulfonate, 2.4 g of N,N-ethylenebis(vinylsulfonacetamide), 1 g of sodium t-octylphenoxyethoxyethanesulfonate, 30 mg of benzoisothizolinone, 37 mg of a fluorine-based surfactant (F-1: N-perfluorooctylsulfonyl-N-propylalanine, potassium salt), 0.15 g of a fluorine-based surfactant (F-2: polyethylene glycol mono (N-perfluorooctylsulfonyl-N-propyl-2-aminoethyl) ether (average polymerization degree of ethylene oxide: 15)), 64 mg of a fluorine-based surfactant (F-3), 32 mg of a fluorine-based surfactant (F-4), 8.8 g of acrylic acid/ethyl acrylate copolymer (copolymerization weight ratio: 5/95), 0.6 g of Aerosol OT (American Cyanamide), 1.8 g of liquid paraffin emulsion (as liquid paraffin), and 950 mL of water were mixed to prepare a back face protecting coating.

<Preparation of Silver Halide Emulsion 1 >

A liquid prepared by adding 3.1 mL of 1% by weight solution of potassium bromide, 3.5 mL of sulfuric acid of a 0.5 mole/L concentration, and 31.7 g of phthalated gelatin to 1421 mL of distilled water was maintained at a temperature of 30° C. while stirring in a stainless-steel reaction vessel, solution A of 22.22 g of silver nitrate in distilled water diluted to 95.4 mL, and solution B of 15.3 g of potassium bromide and 0.8 g of potassium iodide in distilled water diluted to a volume of 97.4 mL were totally added at a constant flow rate in 45 seconds. Thereafter, 10 mL of 3.5% by weight aqueous solution of hydrogen peroxide was added, and 10.8 mL of 10% by weight aqueous solution of benzimidazol was further added. Furthermore, solution C of 51.86 g of silver nitrate in distilled water diluted to 317.5 mL was totally added at a constant flow rate in 20 minutes; and solution D of 2.2 g of potassium iodide in distilled water diluted to a volume of 400 mL was added by the controlled double-jet method maintaining pAg at 8.1. Hexachloroiridic (III) acid, potassium salt was totally added in a quantity ratio of $1\times10^4$ mole to 1 mole of silver 10 minutes after starting the addition of solutions C and D. Also, an aqueous solution of potassium hexacyanoferrate (III) was added in a quantity ratio of $3\times10^{-4}$ mole to 1 mole of silver 5 seconds after completing the addition of solution C. Using sulfuric acid of a 0.5 mole/L concentration, pH was adjusted to 3.8, stirring was stopped, and settling, desalination, and water washing were performed. Using sodium hydroxide of a 1 mole/L concentration, pH was adjusted to 5.9, to form a silver halide dispersion of pAg of 8.0.

The above-described silver halide dispersion was maintained at a temperature of 38° C. while stirring, 5 mL of 0.34% by weight solution of 1,2-benzoisothiazoline-3-one in methanol was added, then 40 minutes later, a methanol solution of spectrally sensitizing dye A and sensitizing dye B in a mole ratio of 1:1 was added in a quantity of $1.2\times10^{-3}$ mole as the total quantity of the sensitizing dyes A and B, and 1 minute later, the temperature was elevated to 47° C. Twenty minutes after the elevation of the temperature, a methanol solution of sodium benzenethio sulfonate was added in a quantity of $7.6\times10^{-5}$ mole to 1 mole of silver, and 5 minutes later, the tellurium sensitizing dye B in a quantity of $2.9\times10^{-4}$ mole to 1 mole of silver was added, and the dispersion was aged for 91 minutes. To the dispersion, 1.3 mL of 0.8% by weight solution of N,N'-dihydroxy-N"-diethylmelamine in methanol was added, and 4 minutes later, a methanol solution of 5-methyl-2-mercaptobenzimidazole was added in a quantity of $4.8\times10^{3}$ mole to 1 mole of silver and a methanol solution of 1-phenyl-2-hyptyl-5-mercapto-1,3,4-triazole was added in a quantity of $5.4\times10^{-3}$ mole to 1 mole of silver, to form silver halide emulsion 1.

The particles in the prepared silver halide emulsion were silver iodide bromide particles evenly containing 3.5 mol % of iodine of an average sphere-equivalent diameter of 0.042 μm and a coefficient of variation of the sphere-equivalent diameter of 20%. The particle size and the like were obtained from the average of 1000 particles using an electron microscope. The ratio of the {100} face of these particles was calculated to be 80% using the Kubelka-Munch method.

<Preparation of Silver Halide Emulsion 2>

Silver halide emulsion 2 was prepared in the same manner as in the preparation of silver halide emulsion 1, except that the liquid temperature in forming particles was changed from 30° C. to 47° C., solution B was changed to 15.9 g of potassium bromide dissolved in distilled water and diluted to 97.4 mL, solution D was changed to 45.8 g of potassium bromide dissolved in distilled water and diluted to 400 mL, time for adding solution C was 30 minutes, and potassium hexacyanoferrate (III) was excluded. In the same manner as in silver halide emulsion 1, precipitation, desalination, water washing, and dispersion were carried out. Furthermore, spectral sensitization and chemical sensitization, and the addition of 5-methyl-2-mercaptobenzimidazole and 1-phenyl-2-heptyl-5-mercapto-1,3,4-triazole were carried out in the same manner as in the preparation of silver halide emulsion 1, except that the quantity of the methanol solution of spectrally sensitizing dye A and sensitizing dye B in a mole ratio of 1:1 was changed to $7.5\times10^{-4}$ mole as the total quantity of the sensitizing dyes A and B, the quantity of the tellurium sensitizing dye B to $1.1\times10^{-4}$ mole to 1 mole of silver, and the quantity of 1-phenyl-2-hyptyl-5-mercapto-1,3,4-triazole was changed to $3.3\times10^{-3}$ mole to 1 mole of silver, to form silver halide emulsion 2. The emulsion particles in silver halide emulsion 2 were pure silver bromide cubic particles of an average sphere-equivalent diameter of 0.008 μm and a coefficient of variation of the sphere-equivalent diameter of 20%.

<Preparation of Silver Halide Emulsion 3>

Silver halide emulsion 3 was prepared in the same manner as in the preparation of silver halide emulsion 1, except that the liquid temperature in forming particles was changed from 30° C. to 27° C. Also, in the same manner as in silver halide emulsion 1, precipitation, desalination, water washing, and dispersion were carried out. In the same manner as in the preparation of silver halide emulsion 1, except that the spectrally sensitizing dye A and spectrally sensitizing dye B in a mole ratio of 1:1 was changed to a solid dispersion (aqueous solution of gelatin) and the quantity was changed to $6\times10^{-3}$ mole as the total quantity of the sensitizing dyes A and B, and the quantity of the tellurium sensitizing dye B to $5.2\times10^{-4}$ mole to 1 mole of silver, to form silver halide emulsion 3. The emulsion particles in the silver halide emulsion 3 were silver iodide bromide particles containing 3.5 mol % of iodine of an average sphere-equivalent diameter of 0.034 μm and a coefficient of variation of the sphere-equivalent diameter of 20%.

<Preparation of Mixed Emulsion A for Coating>

Seventy percent by weight of the silver halide emulsion 1, 15% by weight of the silver halide emulsion 2, and 15% by weight of the silver halide emulsion 3 were dissolved, and $7\times10^{-3}$ mole of benzothiazolium iodide for 1 mole of silver was added in a 1% by weight aqueous solution. Furthermore, water was added so that the content of silver halide in 1 kg of the mixed emulsion for coating became 38.2 g as silver.

<Preparation of Silver Fatty-Acid Salt Dispersion>

A sodium behenate solution was obtained by mixing 87.6 kg of behenic acid (Henkel, tradename: Edenor C22–85R), 423 L of distilled water, 49.2 L of a 5 mole/L aqueous solution of NaOH, and 120 L of tert-butanol, and stirring at 75° C. for 1 hour to allow to react. Separately, 206.2 L of an aqueous solution containing 40.4 Kg of silver nitrate (pH 4.0) was prepared, and maintained at a temperature of 10° C. A reaction vessel containing 635 L of distilled water and 30 L of tert-butanol was maintained at a temperature of 30° C., and the total quantity of the above-described sodium behenate solution and the total quantity of the aqueous solution of silver nitrate were added stirring well in 93 minutes 15 seconds and 90 minutes, respectively. In this time, only the aqueous solution of silver nitrate was added for 11 minutes from the start of adding, then, the addition of the sodium behenate solution was started, and only the sodium behenate solution was for 14 minutes 15 seconds after the completion of adding the aqueous solution of silver nitrate. The temperature in the reaction vessel at this time was 30° C., and the ambient temperature was controlled so that the liquid temperature is maintained constant. The piping for adding the sodium behenate solution was warmed by circulating warm water in the outer pipe of the double-pipe system, and the liquid temperature at the outlet of the adding nozzle was controlled to be 75° C. The piping for adding the aqueous solution of silver nitrate was warmed by circulating cold water in the outer pipe of the double-pipe system. The location of adding the sodium behenate solution and the location of the aqueous solution of silver nitrate were symmetrical about the axis of stirring, and adjusted to the height so as not to contact the reaction liquid.

After completing the addition of the sodium behenate solution, the temperature of the solution was maintained at the same temperature stirring for 20 minutes, and elevated to 35° C. in 30 minutes, and the solution was aged for 210 minutes. Immediately after the completion of aging, pure water was added in the tank to stop aging, the solution was transferred from the feeding kettle by head pressure or using a pump, the solid matter was filtered by centrifugal filtration, and washed with water until the conductivity of the filtrate becomes 30 μS/cm. Thus, the fatty salt of silver was obtained. The obtained solid matter was stored as wet cake (solid content: 45% by weight) without drying.

The form of the obtained silver behenate particles observed by electron microscopic photography was flake crystals having average values of a=0.14 μm, b=0.4 μm, c=0.6 μm; an average aspect ratio of 5.2; an sphere-equivalent diameter of 0.52 μm and a coefficient of variation of the sphere-equivalent diameter of 15%. (a, b, and c are defined herein.)

To the wet cake equivalent to 260 kg of the dry solid, 19.3 kg of polyvinyl alcohol (trade name: PVA-217) and water were added to make the total quantity of 1000 kg, the mixture was made to be slurry using a dissolver blade, and preliminarily dispersed with a pipe-line mixer (MIZUHO, PM-10).

Next, the preliminarily dispersed stock slurry was treated 3 times with a dispersing machine (trade name: Micro Fluidizer M-610, Microfluidex International Corporation, using a Z-type interaction chamber) of which pressure was adjusted to 1260 kg/cm$^2$, to form silver behenate dispersion. The dispersion temperature of 18° C. was maintained by furnishing coiled heat exchangers before and after the interaction chamber, respectively, and controlling the temperature of the coolant.

<Preparation of Reducer-1 Dispersion>

To 10 kg of the reducer-1(1,1-bis(2-hydroxy-3,5-dimethylphenyl)-3,5,5-trimethylhexane) and 10 kg of a 20% by weight aqueous solution of modified polyvinyl alcohol (KURARAY, POVAL MP203), 16 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 3 hours 30 minutes, then, 0.2 g of benzoisothiazolinone sodium salt and water were added to adjust so that the concentration of the reducer became 25% by weight to form a reducer-1 dispersion. The reducer particles in thus obtained reducer dispersion had a median diameter of 0.42 μm and a maximum particle diameter of 2.0 μm or smaller. The obtained reducer dispersion was filtered with a polypropylene filter of a pore diameter of 10.0 μm to remove foreign matter, such as dust, and stored.

<Preparation of Reducer-2 Dispersion>

To 10 kg of the reducer-2(2,2'-isobutylidene-bis-(4,6-dimethylphenol)) and 10 kg of a 20% by weight aqueous solution of modified polyvinyl alcohol (KURARAY, POVAL MP203), 16 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 3 hours 30 minutes, then, 0.2 g of benzoisothiazolinone sodium salt and water were added to adjust so that the concentration of the reducer became 25% by weight to form a reducer-2 dispersion. The reducer particles in thus obtained reducer dispersion had a median diameter of 0.38 μm and a maximum particle diameter of 2.0 μm or smaller. The obtained reducer dispersion was filtered with a polypropylene filter of a pore diameter of 10.0 μm to remove foreign matter, such as dust, and stored.

<Preparation of Reducer Complex-3 Dispersion>

To 10 kg of the reducer complex-3 (1:1 complex of 2,2'-methylene-bis(4-ethyl-6-tert-butylphenol) and hydrogen linkable compound-1 (triphenylphosphine oxide)), 0.12 kg of triphenylphosphine oxide, and 16 kg of a 10% by weight aqueous solution of modified polyvinyl alcohol (KURARAY, POVAL MP203), 7.2 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 4 hours 30 minutes, then, 0.2 g of benzoisothiazolinone sodium salt and water were added to adjust so that the concentration of the reducer became 25% by weight to form a reducer complex-3 dispersion. The reducer particles in thus obtained reducer dispersion had a median diameter of 0.46 μm and a maximum particle diameter of 1.6 μm or smaller. The obtained reducer dispersion was filtered with a polypropylene filter of a pore diameter of 3.0 μm to remove foreign matter, such as dust, and stored.

<Preparation of Reducer-4 Dispersion>

To 10 kg of the reducer-4 (2,2'-methylene-bis(4-ethyl-6-tert-butylphenol)) and 20 kg of a 10% by weight aqueous solution of modified polyvinyl alcohol (KURARAY, POVAL MP203), 6 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 3 hours 30 minutes, then, 0.2 g of benzoisothiazolinone sodium salt and water were added to adjust so that the concentration of the reducer became 25% by weight to form a reducer-4 dispersion. The reducer particles in thus obtained reducer dispersion had a median diameter of 0.40 μm and a maximum particle diameter of 1.5 μm or smaller. The obtained reducer dispersion was filtered with a polypropylene filter of a pore diameter of 3.0 μm to remove foreign matter, such as dust, and stored.

<Preparation of Reducer-5 Dispersion>

To 10 kg of the Reducer-5 (2,2'-methylene-bis(4-methyl-6-tert-butylphenol)) and 20 kg of a 10% by weight aqueous solution of modified polyvinyl alcohol (KURARAY, POVAL MP203), 6 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 3 hours 30 minutes, then, 0.2 g of benzoisothiazolinone sodium salt and water were added to adjust so that the concentration of the reducer became 25% by weight to form a reducer-5 dispersion. The reducer particles in thus obtained reducer dispersion had a median diameter of 0.38 μm and a maximum particle diameter of 1.5 μm or smaller. The obtained reducer dispersion was filtered with a polypropylene filter of a pore diameter of 3.0 μm to remove foreign matter, such as dust, and stored.

<Preparation of Hydrogen Linkable Compound-2 Dispersion>

To 10 kg of the hydrogen linkable compound-2 (tri(4-t-butylphenyl)phosphine oxide) and 20 kg of a 10% by weight aqueous solution of modified polyvinyl alcohol (KURARAY, POVAL MP203), 10 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 3 hours 30 minutes, then, 0.2 g of benzoisothiazolinone sodium salt and water were added to adjust so that the concentration of the reducer became 22% by weight to form a hydrogen linkable compound-2 dispersion. The reducer particles in thus obtained reducer dispersion had a median diameter of 0.35 μm and a maximum particle diameter of 1.5 μm or smaller. The obtained reducer dispersion was filtered with a polypropylene filter of a pore diameter of 3.0 μm to remove foreign matter, such as dust, and stored.

<Preparation of Organic Polyhalogen Compound-1 Dispersion>

To 10 kg of the organic polyhalogen compound-1 (2-tribromomethane sulfonyl naphthalene), 10 kg of a 20% by weight aqueous solution of modified polyvinyl alcohol (KURARAY, POVAL MP203), and 0.4 kg of a 20% by weight aqueous solution of sodium triisopropylnaphthalenesulfonate, 16 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 5 hours, then, 0.2 g of benzoisothiazolinone sodium salt and water were added to adjust so that the concentration of the organic polyhalogen compound became 23.5% by weight to form an organic polyhalogen compound-1 dispersion. The organic polyhalogen compound particles in thus obtained organic polyhalogen compound dispersion had a median diameter of 0.36 μm and a maximum particle diameter of 2.0 μm or smaller. The obtained organic polyhalogen compound dispersion was filtered with a polypropylene filter of a pore diameter of 10.0 μm to remove foreign matter, such as dust, and stored.

<Preparation of Organic Polyhalogen Compound-2 Dispersion>

To 10 kg of the organic polyhalogen compound-2 (tribromomethane sulfonyl benzene), 10 kg of a 20% by weight aqueous solution of modified polyvinyl alcohol (KURARAY, POVAL MP203), and 0.4 kg of a 20% by weight aqueous solution of sodium triisopropylnaphthalenesulfonate, 14 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 5 hours, then, 0.2 g of benzoisothiazolinone sodium salt and water were added to adjust so that the concentration of the organic polyhalogen compound became 26% by weight to form an organic polyhalogen compound-2 dispersion. The organic polyhalogen compound particles in thus obtained organic polyhalogen compound dispersion had a median diameter of 0.41 μm and a maximum particle diameter of 2.0 μm or smaller. The obtained organic polyhalogen compound dispersion was filtered with a polypropylene filter of a pore diameter of 10.0 μm to remove foreign matter, such as dust, and stored.

<Preparation of Organic Polyhalogen Compound-3 Dispersion>

To 10 kg of the organic polyhalogen compound-3 (N-butyl-3-tribromomethanesulfonyl benzamide), 10 kg of a 20% by weight aqueous solution of modified polyvinyl alcohol (KURARAY, POVAL MP203), and 0.4 kg of a 20% by weight aqueous solution of sodium triisopropylnaphthalenesulfonate, 8 kg of water was mixed, and the mixture was stirred well to form a slurry. The slurry was pumped with a diaphragm pump to a horizontal sand mill packed with zirconia beads of an average diameter of 0.5 mm (IMEX, UVM-2), whereby it was dispersed for 5 hours, then, 0.2 g of benzoisothiazolinone sodium salt and water were added to adjust so that the concentration of the organic polyhalogen compound becomes 25% by weight to form an organic polyhalogen compound-3 dispersion. The organic polyhalogen compound particles in thus obtained organic polyhalogen compound dispersion had a median diameter of 0.36 μm and a maximum particle diameter of 1.5 μm or smaller. The obtained organic polyhalogen compound dispersion was filtered with a polypropylene filter of a pore diameter of 3.0 μm to remove foreign matter, such as dust, and stored.

<Preparation of Phthalazine Compound-1 Solution>

Eight kilograms of modified polyvinyl alcohol MP203 (KURARAY) was dissolved in 174.57 kg of water, then 3.15 kg of a 20% by weight aqueous solution of sodium triisopropylnaphthalenesulfonate and 14.28 kg of a 70% by weight aqueous solution of phthalazine compound-1 (6-isopropylphthalazine) were added to prepare 5% by weight solution of phthalazine compound-1.

<Preparation of Mercapto Compound-1 Solution>

Seven grams of mercapto compound-1 (1-(3-sulfophenyl)-5-mercapto tetrazole sodium salt) was dissolved in 993 g of water to prepare 0.7% by weight aqueous solution of mercapto compound-1.

<Preparation of Pigment-1 Dispersion>

To 64 g of C. I. Pigment Blue 60 and 6.4 g of Kao DEMOL N, 250 g of water was added, and the mixture was stirred well to form slurry. Together the slurry, 800 g of zirconia beads of an average diameter of 0.5 mm were fed in a vessel, and dispersed for 25 hours with a dispersing machine (¼G Sand Grinder Mill, IMEX) to form a pigment-1 dispersion. The pigment particles in thus obtained pigment dispersion had an average particle diameter of 0.21 μm.

<Preparation of SBR Latex Emulsion>

SBR latex of a Tg of 23° C. was prepared as follows: Using ammonium persulfate as a polymerization initiator, and an anionic surfactant as an emulsifier, 70.5 parts by weight of styrene, 26.5 parts by weight of butadiene, and 3 parts by weight of acrylic acid were undergone emulsion polymerization, and aged at 80° C. for 8 hours. Thereafter, the emulsion was cooled to 40° C.; the pH was adjusted to 7.0 using ammonia water; and Sandet BL (Sanyo Chemical Industries) was added to a concentration of 0.22%. Next, a 5% aqueous solution of sodium hydroxide was added to pH 8.3, and furthermore, the pH was adjusted to 8.4 using ammonia water. The mole ratio of $Na^+$ ions and $NH_4^+$ ions used in this time was 1:2.3. Furthermore, 0.15 mL of a 7% aqueous solution of benzoisothiazolinone sodium salt was added to 1 kg of the emulsion to prepare an SBR latex emulsion.

(SBR latex: St (70.5)-Bu (26.5)-AA (3)-latex) Tg: 23° C.

Average particle diameter: 0.1 μm; concentration: 43% by weight; equilibrium water content at 25° C., 60% RH: 0.6% by weight; ionic conductivity: 4.2 mS/cm (measured using DKK-TOA conductivity meter CM-30S for the latex stock emulsion (43% by weight) at 25° C.); pH: 8.4

SBR latex of different Tg was prepared by the same manner except for changing the contents of styrene and butadiene.

<Preparation of Emulsion Layer (Light-Sensitive Layer) Coating-1>

The emulsion layer coating prepared by sequentially adding 1000 g of the dispersion of fatty-acid salt of silver obtained as described above, 125 mL of water, 113 g of the dispersion of the reducer-1, 91 g of the dispersion of the reducer-2, 27 g of the dispersion of the pigment-1, 82 g of the dispersion of the organic polyhalogen compound-1, 40 g of the dispersion of the organic polyhalogen compound-2, 173 g of the solution of the phthalazine compound-1, 1082 g of the SBR latex (Tg: 20.5° C.) emulsion, and 9 g of the aqueous solution of the mercapto compound-1, adding 158 g of the silver halide mixed emulsion A immediately before applying, and mixing well was transferred as it is to a coating die and applied.

The viscosity of the emulsion layer coating measured at 40° C. using a B-viscometer (Tokyo Keiki) was 85 mPa·s (No. 1 rotor, 60 rpm).

The viscosities of the coating at 25° C. measured using an RFS Fluid Spectrometer manufactured by Rheometrix Far East at shear rates of 0.1 $s^{-1}$, 1 $s^{-1}$, 10 $s^{-1}$, 100 $s^{-1}$, and 1000 $s^{-1}$ were 1500 mPa·s, 220 mPa·s, 70 mPa·s, 40 mPa·s, and 20 mPa·s, respectively.

<Preparation of Emulsion Layer (Light-Sensitive Layer) Coating-2>

The emulsion layer coating prepared by sequentially adding 1000 g of the dispersion of fatty-acid salt of silver obtained as described above, 104 mL of water, 30 g of the dispersion of the pigment-1, 21 g of the dispersion of the organic polyhalogen compound-2, 69 g of the dispersion of the organic polyhalogen compound-3, 173 g of the solution of the phthalazine compound-1, 1082 g of the SBR latex (Tg: 23° C.) emulsion, 258 g of the dispersion of the reducer complex-3, and 9 g of the solution of the mercapto compound-1, adding 110 g of the silver halide mixed emulsion A immediately before applying, and mixing well was transferred as it is to a coating die and applied.

<Preparation of Emulsion Layer (Light-Sensitive Layer) Coating-3>

The emulsion layer coating prepared by sequentially adding 1000 g of the dispersion of fatty-acid salt of silver obtained as described above, 95 mL of water, 73 g of the dispersion of the reducer-4, 68 g of the dispersion of the reducer-5, 30 g of the dispersion of the pigment-1, 21 g of the dispersion of the organic polyhalogen compound-2, 69 g of the dispersion of the organic polyhalogen compound-3, 173 g of the solution of the phthalazine compound-1, 1082 g of the core-shell type SBR latex (core Tg: 20° C./shell Tg: 30° C.=70/30) emulsion, 124 g of the dispersion of the hydrogen-linkable compound-2, and 9 g of the aqueous solution of the mercapto compound-1, adding 110 g of the silver halide mixed emulsion A immediately before applying, and mixing well was transferred as it is to a coating die and applied.

<Preparation of Intermediate Emulsion Layer Coating>

The intermediate emulsion layer coating prepared by mixing 772 g of a 10% by weight aqueous solution of polyvinyl alcohol PVA-205 (KURARAY), 5.3 g of the dispersion of pigment, 226 g of a 27.5% by weight emulsion of a methyl methacrylate/styrene/butyl acrylate/hydroxyethyl methacrylate/acrylic acid copolymer (copolymerization ratio by weight: 64/9/20/5/2) latex, 2 mL of a 5% by weight aqueous solution of Aerosol OT (American Cyanamide), 10.5 mL of a 20% by weight aqueous solution of diammonium phthalate, and adding water to make the total quantity 880 g, adjusting the pH to 7.5 with NaOH was transferred to a coating die so as to be 10 mL/$m^2$. The viscosity of the coating measured at 40° C. using a B-viscometer was 21 mPa·s (No. 1 rotor, 60 rpm).

<Preparation of First Emulsion Protecting Layer Coating>

The coating prepared by dissolving 64 g of inert gelatin in water, adding 80 g of a 27.5% by weight emulsion of a methyl methacrylate/styrene/butyl acrylate/hydroxyethyl methacrylate/acrylic acid copolymer (copolymerization ratio by weight: 64/9/20/5/2) latex, 23 mL of a 10% by weight methanol solution of phthalic acid, 23 mL of a 10% by weight aqueous solution of 4-methlyphthalic acid, 28 mL of sulfuric acid of a concentration of 0.5 mole/L, 5 mL of a 5% by weight aqueous solution of Aerosol OT (American Cyanamide), 0.5 g of phenoxy ethanol, and 0.1 g of benzoisothiazolinone, adding water to make the total quantity 750 g, and mixing 26 mL of a 4% by weight solution of chrome alum with a static mixer immediately before applying was transferred to a coating die so as to be 18.6 mL/$m^2$. The viscosity of the coating measured at 40° C. using a B-viscometer was 17 mPa·s (No. 1 rotor, 60 rpm).

<Preparation of Second Emulsion Protecting Layer Coating>

The coating for surface-protecting layer prepared by dissolving 80 g of inert gelatin in water, adding 102 g of a 27.5% by weight emulsion of a methyl methacrylate/styrene/butyl acrylate/hydroxyethyl methacrylate/acrylic acid copolymer (copolymerization ratio by weight: 64/9/20/5/2) latex, 3.2 mL of a 5% by weight solution of a fluorine-based surfactant (F-1: N-perfluorooctylsulfonyl-N-propylglycine potassium salt), 32 mL of a 2% by weight aqueous solution of a fluorine-based surfactant (F-2: polyethyleneglycol mono(N-perfluorooctylsulfonyl-N-propyl-2-aminoethyl) ether (average degree of polymerization of ethylene oxide=15), 23 mL of a 5% by weight solution of Aerosol OT (American Cyanamide), 4 g of fine particles of polymethyl methacrylate (average particle diameter: 0.7 μm), 21 g of fine particles of polymethyl methacrylate (average particle diameter: 4.5 μm), 1.6 g of 4-methyl phthalic acid, 4.8 g of phthalic acid, 44 mL of sulfuric acid of a concentration of 0.5 mole/L, and 10 mg of benzoisothiazolinone, adding water to make the total quantity 650 g, and mixing 445 mL of an aqueous solution containing 4% by weight chrome alum and 0.67% by weight phthalic acid with a static mixer immediately before applying was transferred to a coating die so as to be 8.3 mL/$m^2$.

The viscosity of the coating measured at 40° C. using a B-viscometer was 9 mPa·s (No. 1 rotor, 60 rpm).

<Preparation of Thermal-Developable Light-Sensitive Material-1>

To the back-face side of the above-described primer support, the anti-halation layer coating is applied so that the applied quantity of the solid matter of the fine solid particle dye becomes 0.04 g/$m^2$, and the back-face protecting layer coating is simultaneously applied so that the gelatin quantity becomes 1.7 g/$m^2$, dried to form a back layer. To the surface opposite to the back face, from the primer surface, the emulsion layer, the intermediate layer, the first protecting layer, and the second protecting layer were simultaneously applied in this order in slide-bead application method to form the sample of the thermal-developable light-sensitive material. In this time, the temperatures of the emulsion layer and the intermediate layer, the first protecting layer, and the second protecting layer were adjusted to 31° C., 36° C., and 37° C., respectively.

The applied quantity (g/$m^2$) of each compound to the emulsion layer is as follows:

| | |
|---|---|
| Silver behenate | 6.19 |
| Reducer-1 | 0.67 |
| Reducer-2 | 0.54 |
| Pigment (C. I. Pigment Blue 60) | 0.032 |
| Polyhalogen compound-1 | 0.46 |
| Polyhalogen compound-2 | 0.25 |
| Phthalazine compound-1 | 0.21 |
| SBR latex | 11.1 |
| Mercapto compound-1 | 0.002 |
| Silver halide (as Ag) | 0.145 |

Applying and drying conditions were as follows:

Applying was performed at a speed of 160 m/min, a distance between the end of the coating die and the support of 0.10 mm and 0.30 mm, and the pressure of the reduced-pressure chamber was set 196 Pa to 882 Pa lower than atmospheric pressure. The support was ionized with ion wind before applying.

In the following chilling zone, the coating was cooled with the air of a dry-bulb temperature between 10° C. and 20° C., then transferred without contacting, and dried in a contactless helical dryer with the dry air of a dry-bulb temperature between 23° C. and 45° C. and a wet-bulb temperature between 15° C. and 21° C.

After drying, the humidity was adjusted to 40% RH to 60% RH at 25° C., and the film surface was heated to a temperature between 70° C. and 90° C. After heating, the film surface was cooled to 25° C.

The mat degree of the formed thermal-developable light-sensitive material was a Beck flatness of 550 seconds on the surface of the light-sensitive layer, and 130 seconds on the back face. The pH measured on the film surface of the light-sensitive layer surface side was 6.0.

<Preparation of Thermal-Developable Light-Sensitive Material-2>

Thermal-developable light-sensitive material-2 was prepared in the same manner as the thermal-developable light-sensitive material-1, except that the emulsion layer coating-1 was changed to the emulsion layer coating-2, and the yellow dye compound 15 was excluded from the anti-halation layer.

The applied quantity (g/m$^2$) of each compound to the emulsion layer in this time is as follows:

| | |
|---|---|
| Silver behenate | 6.19 |
| Pigment (C. I. Pigment Blue 60) | 0.036 |
| Polyhalogen compound-2 | 0.13 |
| Polyhalogen compound-3 | 0.41 |
| Phthalazine compound-1 | 0.21 |
| SBR latex | 11.1 |
| Reducer complex-3 | 1.54 |
| Mercapto compound-1 | 0.002 |
| Silver halide (as Ag) | 0.10 |

<Preparation of Thermal-Developable Light-Sensitive Material-3>

Thermal-developable light-sensitive material-3 was prepared in the same manner as the thermal-developable light-sensitive material-1, except that the emulsion layer coating-1 was changed to the emulsion layer coating-3; the yellow dye compound 15 was excluded from the anti-halation layer; fluorine-based surfactants F-1, F-2, F-3, and F-4 in the second protecting layer and the back-face protecting layer were changed to fluorine-based surfactants F-5, F-6, F-7, and F-8 of the same weightes, respectively.

The applied quantity (g/m$^2$) of each compound to the emulsion layer in this time is as follows:

| | |
|---|---|
| Silver behenate | 5.57 |
| Pigment (C. I. Pigment Blue 60) | 0.032 |
| Reducer-4 | 0.40 |
| Reducer-5 | 0.36 |
| Polyhalogen compound-2 | 0.12 |
| Polyhalogen compound-3 | 0.37 |
| Phthalazine compound-1 | 0.19 |

-continued

| | |
|---|---|
| SBR latex | 10.0 |
| Hydrogen-bondable compound-2 | 0.59 |
| Mercapto compound-1 | 0.002 |
| Silver halide (as Ag) | 0.09 |

(Evaluation of Photographic Performance)

With a Fuji Medical Dry Laser Imager FM-DPL (incorporating a 660-nm semiconductor laser of a maximum output of 60 mW (IIIB), a photographic material was exposed and heat-developed (total of 24 seconds by four panel heaters set to 112° C., 119° C., 121° C., and 121° C.), and the obtained image was evaluated with a photographic densitometer.

As described above, according to the method and apparatus for solution preparation of photographic reagents of the present invention, the problems of the time elapse in melt, reagent loss, and mutual contamination in the solution preparation of photographic reagents can be effectively prevented.

In addition, according to the method and apparatus for preparation of silver halide grains of the present invention, the grain diameter and distribution width thereof can be made small in the preparation of the silver halide grains for use in the preparation of silver halide emulsions. In the process of adding the sensitizing dye, the sensitizing dye remaining in the process can be reliably deactivated, and no rinsing water waste is generated. Thus, the present invention is of course suitable for the method and apparatus for preparation of a silver halide emulsion for use in a silver halide photographic material, and particularly suitable for the method and apparatus for preparation of a silver halide emulsion for use in a heat-developable photosensitive material.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for liquid preparation of photographic reagents that require heat-melting prior to use, the method of comprising the steps of:

(i) transferring, with a pump, a photographic reagent to a measuring tank via piping without being heated;

(ii) measuring the amount of photographic reagent transferred to the measuring tank;

(iii) after measuring, heat-melting the photographic reagent; and (iv) repeating steps (i) to (iii) for each additional batch of liquid photographic reagent to be prepared.

2. The method according to claim 1, wherein the photographic reagent is a prepared liquid of silver halide emulsion for use in a heat-developable photosensitive material.

3. The method according to claim 1, which comprises measuring, in said measuring tank, the amount of photographic reagent transferred to the measuring tank.

4. The method according to claim 1, said method further comprising the step of driving the pump to rotate backwards so that air is blown into the piping from a transfer-directional end of the piping for backward washing of an interior of the piping.

* * * * *